US008993203B2

(12) United States Patent
Fujii

(10) Patent No.: US 8,993,203 B2
(45) Date of Patent: Mar. 31, 2015

(54) ELECTROPHOTOGRAPHIC PHOTORECEPTOR, ELECTROPHOTOGRAPHIC PHOTORECEPTOR CARTRIDGE AND IMAGE FORMING APPARATUS

(71) Applicant: Mitsubishi Chemical Corporation, Chiyoda-ku (JP)

(72) Inventor: Akiteru Fujii, Kanagawa (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 13/761,361

(22) Filed: Feb. 7, 2013

(65) Prior Publication Data

US 2013/0209929 A1 Aug. 15, 2013

(30) Foreign Application Priority Data

Feb. 10, 2012 (JP) ..... 2012-027438

(51) Int. Cl.

| | |
|---|---|
| ***G03G 5/047*** | (2006.01) |
| ***G03G 5/06*** | (2006.01) |
| ***G03G 21/18*** | (2006.01) |
| ***G03G 5/05*** | (2006.01) |

(52) U.S. Cl.

CPC ..... *G03G 5/0614* (2013.01); *G03G 21/18* (2013.01); *G03G 5/047* (2013.01); *G03G 5/0564* (2013.01); *G03G 5/0607* (2013.01); *G03G 2215/00957* (2013.01)

USPC ..... 430/58.65; 430/58.8; 430/58.75; 430/59.6; 430/73; 430/96; 399/159

(58) Field of Classification Search

CPC . G03G 5/0564; G03G 5/0607; G03G 5/0605; G03G 5/0614

USPC ..... 430/58.65, 58.75, 96, 59.6, 73, 58.8

See application file for complete search history.

(56) References Cited

U.S. PATENT DOCUMENTS

| | | | | |
|---|---|---|---|---|
| 5,059,503 | A * | 10/1991 | Muto et al. | 430/83 |
| 5,098,809 | A | 3/1992 | Kikuchi et al. | |
| 5,958,637 | A * | 9/1999 | Morishita et al. | 430/58.45 |
| 6,190,811 | B1 * | 2/2001 | Tanaka et al. | 430/78 |
| 2003/0186144 | A1 * | 10/2003 | Kunieda et al. | 430/58.8 |
| 2005/0287453 | A1 | 12/2005 | Ioannidis et al. | |
| 2010/0221040 | A1 * | 9/2010 | Mitsumori | 430/58.75 |

FOREIGN PATENT DOCUMENTS

| | | | | |
|---|---|---|---|---|
| JP | 2-230255 | | 9/1990 | |
| JP | 09043877 | A * | 2/1997 | G03G 5/06 |
| JP | 9-281728 | | 10/1997 | |
| JP | 10-20523 | | 1/1998 | |
| JP | 2000-221713 | | 8/2000 | |
| JP | 2003021921 | A * | 1/2003 | G03G 5/06 |
| JP | 2003316035 | A * | 11/2003 | G03G 5/047 |
| JP | 2006-18266 | | 1/2006 | |
| JP | 2009-109649 | | 5/2009 | |
| JP | 2009128544 | A * | 6/2009 | |

OTHER PUBLICATIONS

English language machine translation of JP 09-043877 (Feb. 1997).*
English language machine translation of JP 2009-128544 (Jun. 2009).*
English language machine translation of JP 2003-316035 (Nov. 2003).*
U.S. Appl. No. 13/761,333, filed Feb. 7, 2013, Fujii.

* cited by examiner

*Primary Examiner* — Christopher Rodee
(74) *Attorney, Agent, or Firm* — Oblon, McClelland, Maier & Neustadt, L.L.P.

(57) ABSTRACT

An electrophotographic photoreceptor, an electrophotographic photoreceptor cartridge, and an image forming apparatus, which are excellent in electrical characteristics such as a responsivity and at the same time, excellent in the crack resistance, are provided. Two kinds of charge transport substances each having a specific structure and a polycarbonate resin having a specific structure are combined, whereby the electrical characteristics such as responsivity and the crack resistance can be improved at the same time.

6 Claims, 1 Drawing Sheet

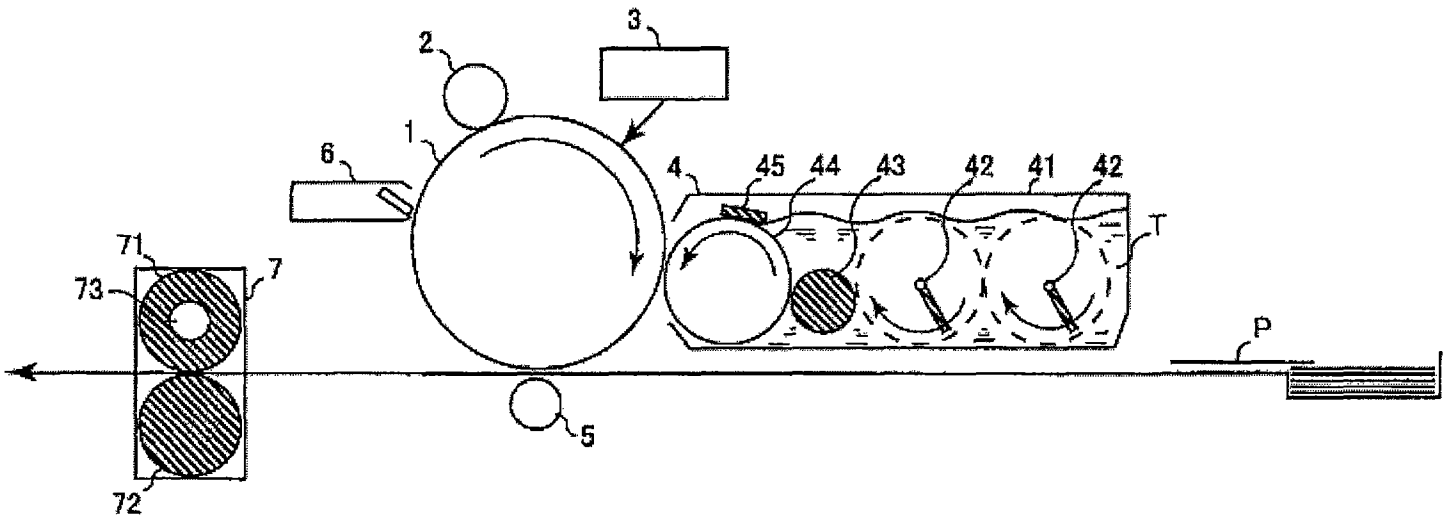
P
T
42
41
42
43
44
45
4
3
2
1
6
5
7
71
73
72

ELECTROPHOTOGRAPHIC PHOTORECEPTOR, ELECTROPHOTOGRAPHIC PHOTORECEPTOR CARTRIDGE AND IMAGE FORMING APPARATUS

CROSS-REFERENCE TO RELATED APPLICATIONS

This application is based upon and claims the benefit of priority to Japanese Application No. 2012-027438 filed on Feb. 10, 2012, the entire content of which is hereby incorporated by reference.

BACKGROUND OF THE INVENTION

1. Field of Invention

The present invention relates to an electrophotographic photoreceptor having excellent electrical characteristics and anti-cracking characteristics, an electrophotographic photoreceptor cartridge manufactured using the electrophotographic photoreceptor, and an image forming apparatus.

2. Background of Invention

Along with general-purpose applications of an electrophotographic technology, an image forming apparatus of an electrophotographic system has come into use in various image forming processes. In particular, downsizing of devices for office applications and the like is proceeding. In turn, as concerns the electrophotographic photoreceptor (hereinafter, sometimes referred to as "photoreceptor"), size reduction proceeds and to keep step with speeding-up of the printing speed, out of characteristics of the photoreceptor, quick responsivity, that is, rapid attenuation of the surface potential after imagewise exposure, becomes an important condition. The responsivity corresponds to light attenuation for a given exposure dose and therefore, it also becomes a necessary condition in many cases to elevate the sensitivity. Furthermore, from the standpoint of achieving a high image quality, it is demanded that the electrical characteristics have repetition stability and the photosensitive layer is free from production of a geometric defect or attachment of a material.

Patent Document 1 discloses that a high-sensitive photoreceptor with good repetition stability can be obtained by using a specific fluorene-based compound as the charge transport substance. Patent Document 2 discloses a single layer-type photoreceptor in which a transfer memory is caused to hardly occur by using the above-described fluorene-based compound and a diphenoquinone-based compound. Patent Document 3 discloses that the sensitivity, repetition characteristics and transfer memory are improved by combining the above-described fluorene-based compound and a diamine compound.

Furthermore, along with cost reduction of an electrophotographic apparatus, use of an inexpensive member is expanding. In particular, as concerns the member that comes into contact with the photoreceptor, such as charging roller and developing roller, various additives and the like such as plasticizer are used and therefore, not only contamination of the photoreceptor surface is merely caused but also cracking attributable to an attached material is sometimes generated in the photoreceptor surface. Such a crack sometimes emerges as an image defect and becomes a fatal defect in view of image quality. There are various views as to the cause for a crack, but it is considered that cracking is partly attributed to elution of a photoreceptor component and formation of a void, which are caused by an attached material on the photoreceptor surface, and this is known to be improved by the composition of the photosensitive layer.

With respect to resistance against the above-described cracking, in Patent Document 4, whether cracking of a photosensitive layer after long time storage of a sebum-attached photosensitive layer, which is also called solvent cracking, occurs or not is described including the photosensitive layer compositions disclosed in Patent Documents 1 to 3. Observation results of cracking due to attachment of sebum are not only indicative of the effect of literal finger contact with the photosensitive layer but also applicable to a case where an extraneous material derived from a member such as roller is attached, and these properties are often collectively called crack resistance.

The crack resistance is evaluated in many cases by the presence or absence of cracking when, as described above, sebum is attached and the photoreceptor is stored for a long time. However, in this method, not only individual difference in the evaluation or reproducibility varies greatly but also quantitative determination of the crack resistance is difficult. In addition, the test by attachment of sebum cannot be a good evaluation method as the method for evaluating the resistance to the above-described component that is bled out from a member put into contact with the photoreceptor, because the mechanism of cracking differs or the load on the photoreceptor is often insufficient and the test results are diverged from each other in many cases.

DOCUMENT LIST

[Patent document 1] JP-A-2-230255 (the term "JP-A" as used herein means an "unexamined published Japanese patent application")
[Patent Document 2] JP-A-9-281728
[Patent Document 3] JP-A-2000-221713
[Patent Document 4] JP-A-10-20523

SUMMARY OF THE INVENTION

According to studies by the present inventors, even a photoreceptor exhibiting good crack resistance in the sebum test described in Patent Document 3 cannot withstand a stricter crack resistance test. The stricter crack resistance test is a test where a photoreceptor sheet is coated with a solvent and pulled with a constant force in a fixed direction and the time until cracking occurs is measured. In this test, the strength of the photoreceptor against a cracking attributable to a member, which is caused after a plasticizer or the like is transferred, is quantitatively expressed. Furthermore, although Patent Document 4 discloses that the crack resistance can be improved by incorporating a specific polyester resin into the photoreceptor, even when this polyester resin is used in the configuration described in Patent Document 3, the resistance to cracking attributable a member cannot be sufficiently satisfied.

The present inventors have made by taking into consideration the above-described problems, and an object of the present invention is to quantitatively assess the resistance against cracking attributable to a contact member and thereby provide an electrophotographic photoreceptor, an electrophotographic cartridge, and an image forming apparatus, which are excellent in both the electrical characteristics such as responsivity and the crack resistance.

As a result of intensive studies, the present inventors have found that the crack resistance is improved by using a charge transport substance and a polyester resin each having a specific structure. The present invention has been accomplished based on this finding.

The gist of the present invention resides in the following <1> to <6>.

<1> An electrophotographic photoreceptor comprising a conductive support and a photosensitive layer on the conductive support, wherein the photosensitive layer comprises: a charge transport substance represented by the following formula (2); a charge transport substance represented by the following formula (6); and a polycarbonate resin having a structural unit represented by the following formula (5) as a binder resin, and the charge transport substances represented by the following formulae (6) and (2) and the polycarbonate resin having a structural unit represented by the following formula (5) are present in the same layer:

(2)

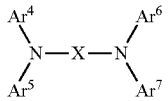

wherein each of $Ar^4$ to $Ar^7$ independently represents an aryl group having a carbon number of 30 or less, which may have a substituent, and X represents a divalent substituent represented by the following formula (3) or (4);

(3)

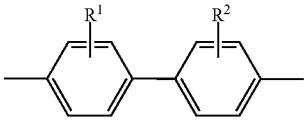

(4)

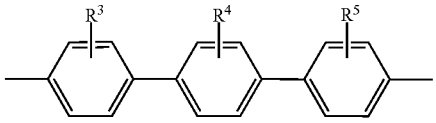

wherein each of $R^1$ to $R^5$ independently represents a hydrogen atom or an alkyl group having a carbon number of 6 or less, provided that when X is the divalent substituent represented by formula (3), each of $Ar^4$ and $Ar^6$ is independently a phenyl group which may have a substituent and each of $Ar^5$ and $Ar^7$ is independently a naphthyl group which may have a substituent;

(6)

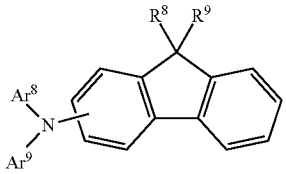

wherein each of $Ar^8$ and $Ar^9$ independently represents an aryl group having a carbon number of 30 or less, which may have a substituent, and each of $R^8$ and $R^9$ independently represents a hydrogen atom or an alkyl group having a carbon number of 6 or less;

(5)

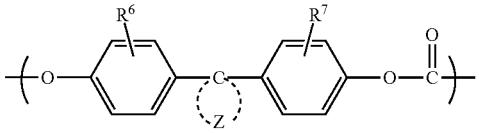

wherein each of $R^6$ and $R^7$ represents a hydrogen atom or an alkyl group having a carbon number of 4 or less, and Z represents a cyclic aliphatic alkyl group having a total carbon number of 5 to 9 including the carbon atom of the bonding site.

<2> The electrophotographic photoreceptor as described in the item <1>, wherein the photosensitive layer contains a gallium phthalocyanine as a charge generating substance.

<3> An electrophotographic photoreceptor cartridge comprising: the electrophotographic photoreceptor as described in the item <1> or <2>; and at least one member selected from the group consisting of a charging device for charging the electrophotographic photoreceptor, an exposure device for exposing the charged electrophotographic photoreceptor to form an electrostatic latent image and a developing device for developing the electrostatic latent image formed on the electrophotographic photoreceptor.

<4> An image forming apparatus comprising: the electrophotographic photoreceptor as described in the item <1> or <2>; a charging device for charging the electrophotographic photoreceptor; an exposure device for exposing the charged electrophotographic photoreceptor to form an electrostatic latent image; and a developing device for developing the electrostatic latent image formed on the electrophotographic photoreceptor.

<5> The image forming apparatus as described in the item <4>, which employs a contact developing system.

<6> The image forming apparatus as described in the item <4> or <5>, which employs a contact charging system.

In the present invention, the charge transport substances having a specific structure are incorporated into the photosensitive layer, whereby an electrophotographic photoreceptor, an electrophotographic cartridge, and an image forming apparatus, which are excellent in electrical characteristics such as a quick responsivity and at the same time, free from cracking due to various contact members, can be provided.

BRIEF DESCRIPTION OF THE DRAWINGS

FIG. 1 shows a schematic view illustrating the configuration of main parts of one embodiment of the image forming apparatus of the present invention.

DESCRIPTION OF REFERENCE NUMERALS AND SIGNS

1 Photoreceptor (electrophotographic photoreceptor)
2 Charging device (charging roller; charging unit)
3 Exposure device (exposure unit)
4 Developing device (developing unit)
5 Transfer device
6 Cleaning device
7 Fixing device
41 Developing tank
42 Agitator
43 Feed roller
44 Developing roller
45 Regulating member
71 Upper fixing member (fixing roller)

72 Lower fixing member (fixing roller)
73 Heating device
T Toner
P Recording paper (paper, medium)

DETAILED DESCRIPTION OF THE INVENTION

The mode for carrying out the present invention is described in detail below. However, the constituent requirements described below are representative examples of the embodiment of the present invention, and the present invention can be performed by making arbitrary modifications therein without departing from the purport of the present invention.

<Charge Transport Substance of the Present Invention>

As the charge transport substance of the present invention, the compound represented by the following formula (2) and the compound represented by the following formula (6) are used by mixing these compounds in the same layer.

(6)

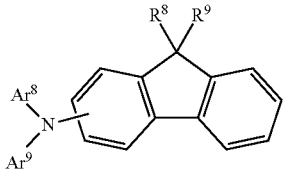

In formula (6), each of $Ar^8$ and $Ar^9$ independently represents an aryl group having a carbon number of 30 or less, which may have a substituent, and each of $R^8$ and $R^9$ independently represents a hydrogen atom or an alkyl group having a carbon number of 6 or less. In formula (6), each of $Ar^8$ and $Ar^9$ independently represents an aryl group having a carbon number of 30 or less, which may have a substituent. The carbon number of the aryl group is 30 or less, preferably 20 or less, more preferably 15 or less. Specific examples thereof include a phenyl group, a naphthyl group, an anthranyl group, and a pyrenyl group. In view of synthesis, a phenyl group or a naphthyl group is preferred, and a phenyl group is most preferred. The total carbon number of the substituent which may be substituted on $Ar^8$ and $Ar^9$ is 30 or less and in view of solubility and synthesis, preferably 20 or less, more preferably 10 or less. Specific examples thereof include an alkyl group, an alkoxy group, an amino group, and an aryl group, and among these, in view of electrical characteristics, an alkyl group is preferred. The carbon number of the alkyl group is 10 or less, preferably 6 or less, more preferably 4 or less. The substitution position is preferably the ortho-position with respect to the nitrogen atom in view of light fatigue and is preferably the para-position in view of electrical characteristics.

In $R^8$ and $R^9$, the carbon number of the alkyl group is 6 or less, preferably 4 or less, more preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group or an ethyl group is preferred, and a methyl group is most preferred. In view of chemical stability, $R^8$ and $R^9$ both are preferably an alkyl group having a carbon number of 6 or less, more preferably an alkyl group having a carbon number of 4 or less, and most preferably a methyl group.

(2)

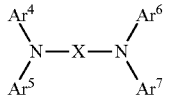

In formula (2), X represents a divalent substituent represented by formula (3) or (4). Each of $R^1$ to $R^5$ represents a hydrogen atom or an alkyl group having a carbon number of 4 or less. In $R^1$ to $R^5$, the carbon number of the alkyl group is 4 or less, preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group or an ethyl group is preferred, and a methyl group is most preferred. The substitution number of the alkyl group is, per one benzene ring, preferably 2 or less, more preferably 1 or less, and most preferably 0, that is, all are a hydrogen atom.

(3)

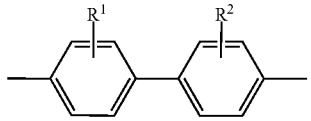

(4)

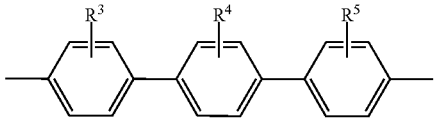

In formula (2), each of $Ar^4$ to $Ar^7$ independently represents an aryl group having a carbon number of 30 or less, which may have a substituent. However, when X is formula (3), each of $Ar^4$ and $Ar^6$ is independently a phenyl group which may have a substituent and each of $Ar^5$ and $Ar^7$ is independently a naphthyl group which may have a substituent. The carbon number of the aryl group is 30 or less, preferably 20 or less, more preferably 15 or less. Specific examples thereof include a phenyl group, a naphthyl group, an anthranyl group, and a pyrenyl group. In view of synthesis, a phenyl group or a naphthyl group is preferred, and a phenyl group is most preferred. The total carbon number of the substituent which may be substituted on $Ar^4$ to $Ar^7$ is 30 or less and in view of solubility and synthesis, preferably 20 or less, more preferably 10 or less. Specific examples of the substituent include an alkyl group, an alkoxy group, an amino group, and an aryl group. Among these, an alkyl group or an alkoxy group is preferred in view of low residual potential and an alkyl group is preferred in view of responsivity. The carbon number of the alkyl group is 6 or less, preferably 4 or less, more preferably 3 or less. The alkyl group specifically includes a linear alkyl group such as methyl group, ethyl group and propyl group, a branched alkyl group such as isopropyl group, tert-butyl group and isobutyl group, and a cyclic alkyl group such as cyclohexyl group and cyclopentyl group. Among these, in view of synthesis, a methyl group is most preferred. Also, the substituents may combine with each other to form a ring. For example, two alkyl groups may circularly combine to form a cycloalkyl group or be ester-crosslinked to form a lactone or the like. The number of substituents is, per one aryl group, usually 3 or less, preferably 2 or less. The total number of substituents on $Ar^4$ to $Ar^7$ is usually 8 or less, preferably 6 or less, and usually 0 or more, preferably 2 or more.

In the case where each of $Ar^4$ to $Ar^7$ is independently a phenyl group which may have a substituent, generally, the substitution position of the substituent which may be substituted on is preferably the ortho-position with respect to the nitrogen atom in view of light fatigue and is preferably the meta-position in view of solubility, but this configuration may impair the crack resistance.

However, when X is represented by formula (3) and at the same time, when each of $Ar^4$ and $Ar^6$ is independently a phenyl group which may have a substituent and each of $Ar^5$ and $Ar^7$ is independently a naphthyl group which may have a substituent, substitution of a substituent on the meta-position of the phenyl group is rather preferred, because the crack resistance is not deteriorated and the solubility is appropriately enhanced.

In addition, when X is represented by formula (4) and all of $Ar^4$ to $Ar^7$ are each independently a phenyl group which may have a substituent, substitution of a substituent on the meta-position of the phenyl group is also rather preferred, because the crack resistance is not deteriorated and the solubility is appropriately enhanced. Furthermore, it is preferred to form a mixture of compounds differing in the position of substituent and the substitution number, because the solubility is also enhanced.

The mixing ratio between the charge transport substance represented by formula (6) and the charge transport substance represented by formula (2) is usually from 20:80 to 95:5, preferably from 30:70 to 90:10, more preferably from 40:60 to 90:10. If the proportion of the charge transport substance represented by formula (6) is too large, the crack resistance may be deteriorated, whereas if the proportion of the charge transport substance represented by formula (2) is too large, the solubility may be deteriorated to cause precipitation of the substance in the photosensitive layer and this may affect the electrical characteristics, particularly, the responsivity.

The total amount of the charge transport substance represented by formula (6) and the charge transport substance represented by formula (2) is, in terms of the weight per 100 parts by weight of the binder resin, in view of electrical characteristics, usually 40 parts by weight of more, preferably 60 parts by weight or more, more preferably 70 parts by weight or more, and in view of crack resistance and wear resistance, usually 150 parts by weight or less, preferably 120 parts by weight or less, more preferably 110 parts by weight or less.

Examples of the structure of the charge transport substance suitable for the present invention are illustrated below. The following structures are examples for more specifically illustrating the present invention, and the present invention is not limited to these structures as long as the concept of the present invention is observed.

(1)-1

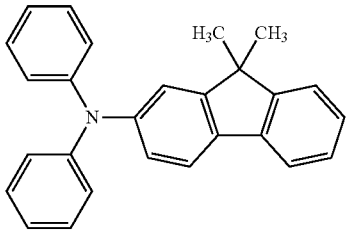

(1)-2

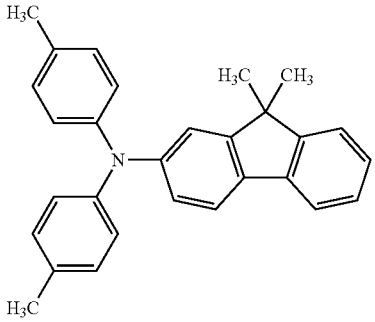

(1)-3

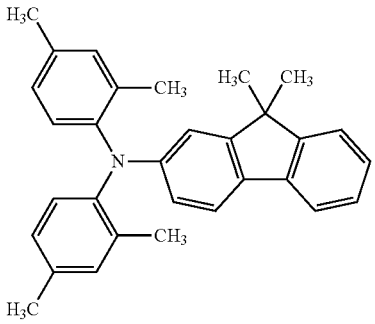

(1)-4

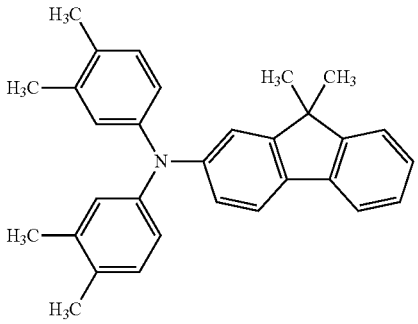

(1)-5

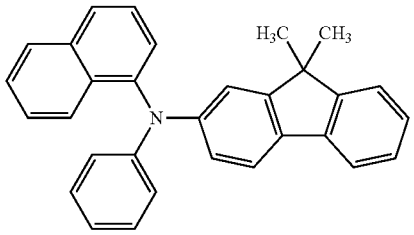

(1)-6

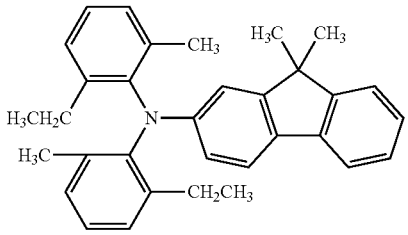

-continued
(1)-7
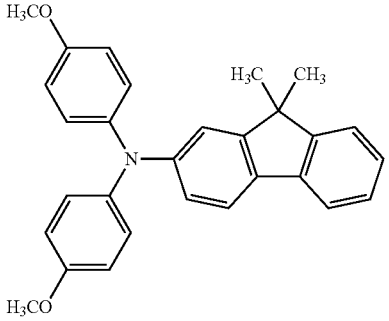
(1)-8
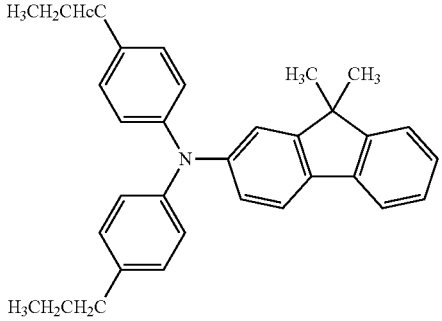
(1)-9
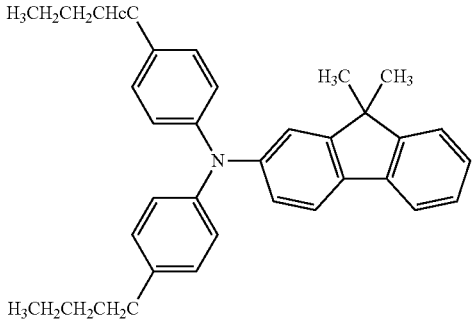
(1)-10
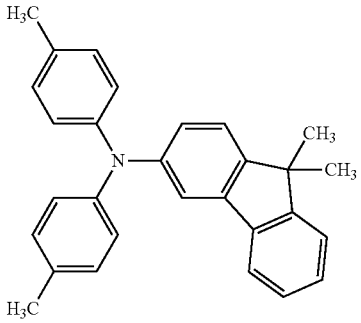
(1)-11
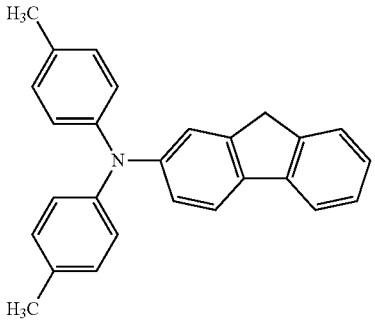
(1)-12
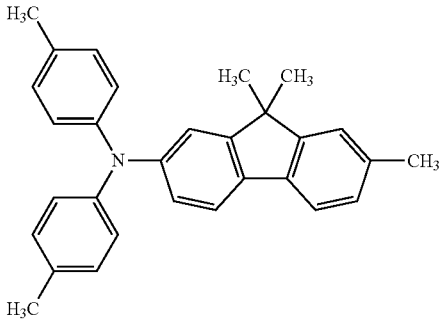
(2)-1
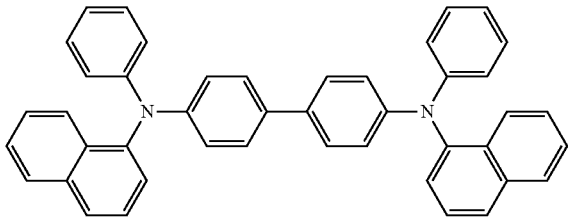
(2)-2
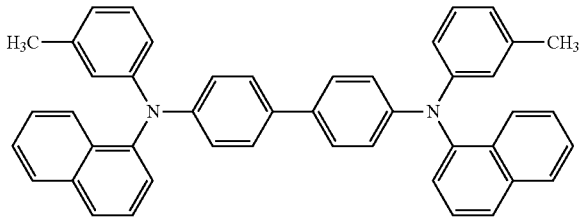
(2)-3
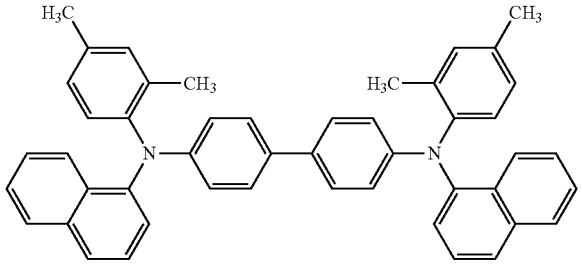
(2)-4
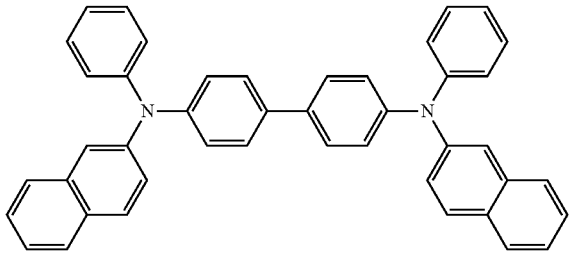

-continued
(2)-5
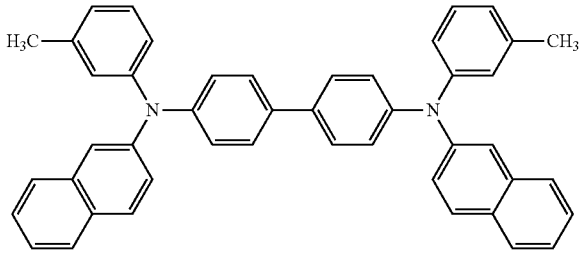
(2)-6
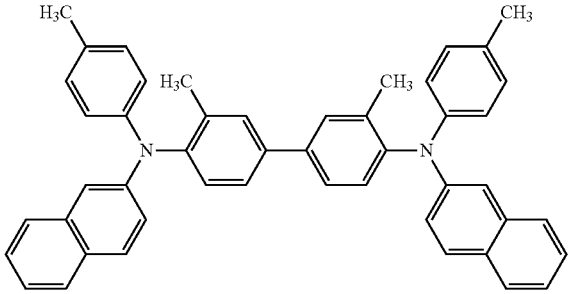
(2)-7
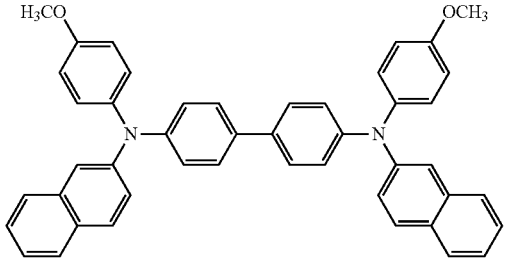
(2)-8
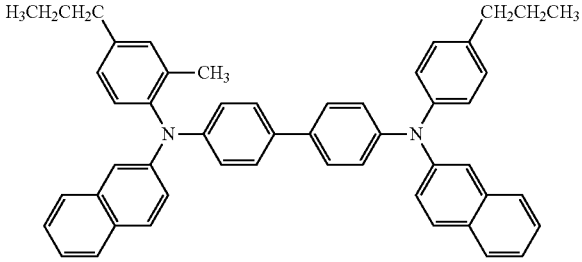
(2)-9
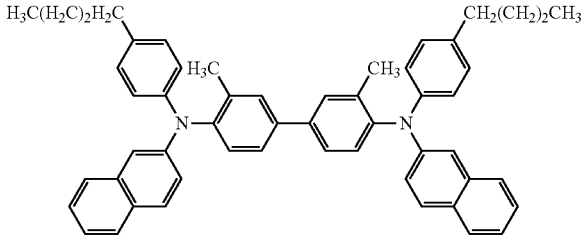
(2)-10
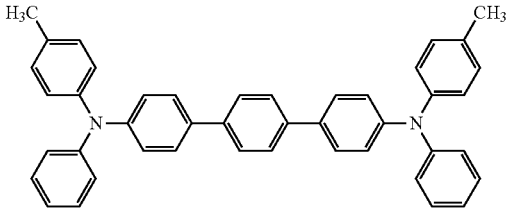
2-(11)
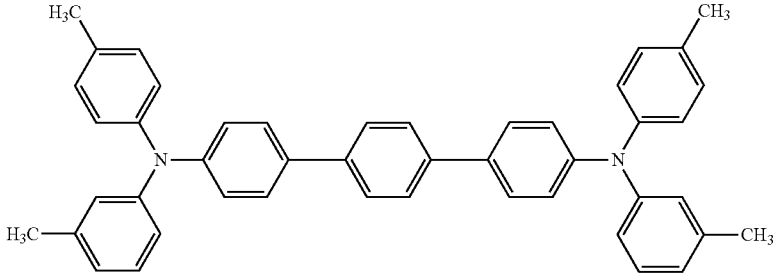
(2)-12
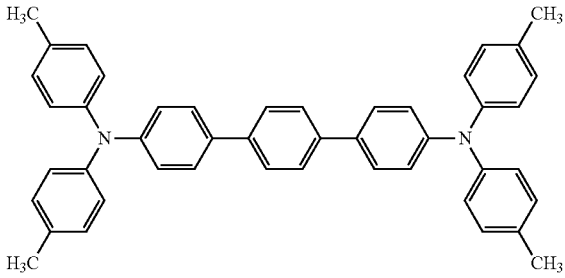
(2)-13
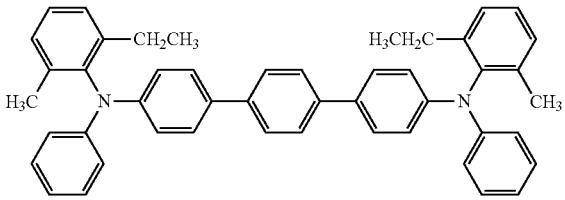

-continued
(2)-14
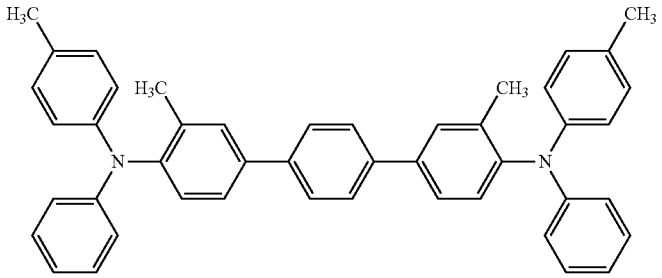
(2)-15
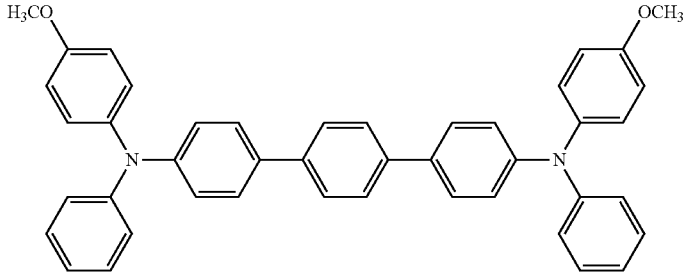
(2)-16
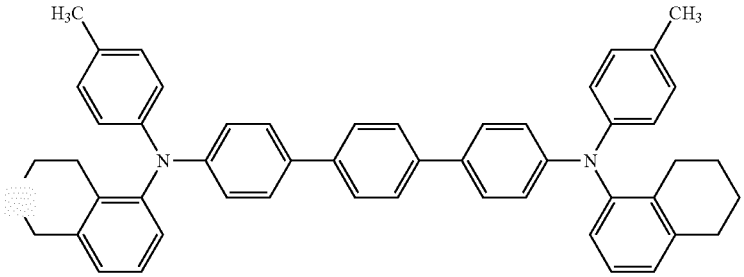
(2)-17
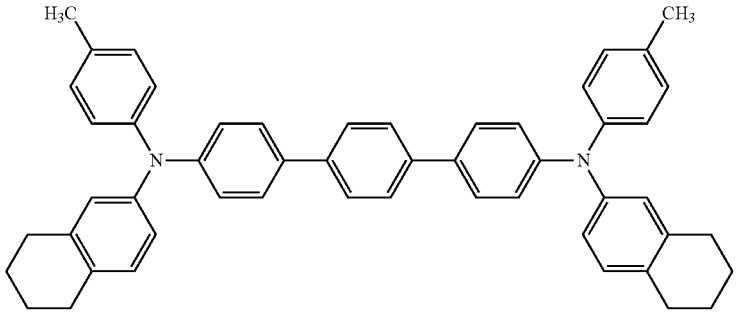
(2)-18
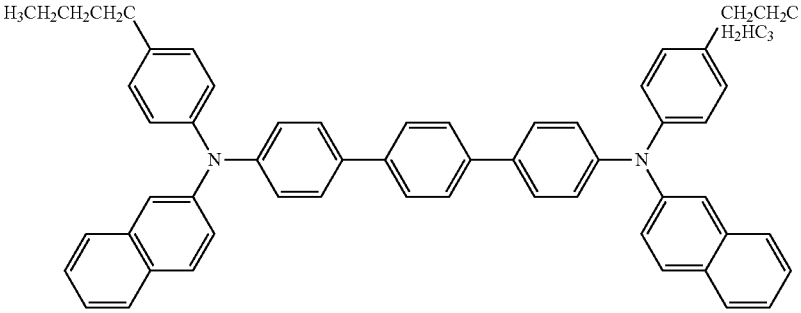

<<Electrophotographic Photoreceptor>>

The configuration of the electrophotographic photoreceptor of the present invention is described below. The electrophotographic photoreceptor of the present invention is not particularly limited in its structure as long as a photosensitive layer containing the above-described charge transport substances represented by formulae (2) and (6) in the same layer and the polycarbonate resin having a structural unit represented by the following formula (5) is provided on a conductive support. In the case where the photosensitive layer of the electrophotographic photoreceptor is of the later-described laminate type, the charge transport layer contains the charge transport substances represented by formulae (2) and (6) and the polycarbonate resin having a structural unit represented by the following formula (5) and, if desired, additionally contains an antistatic layer, a leveling agent and other additives. Also, in the case where the photosensitive layer of the electrophotographic photoreceptor is of the later-described single-layer type, a charge generating substance and an electron transport substance are generally used in addition to the above-described components used in the charge transport layer of the laminate-type photoreceptor.

<Conductive Support>

The conductive support is not particularly limited, but examples of the support which is mainly used include a metal material such as aluminum, aluminum alloy, stainless steel, copper and nickel; a resin material in which an electrically conductive powder such as metal, carbon and tin oxide is added to impart electrical conductivity; and a resin, glass or paper, on which surface an electrically conductive material such as aluminum, nickel and ITO (indium tin oxide) is deposited or coated. One of these materials may be used alone, or two or more thereof may be used in combination by employing an arbitrary combination and an arbitrary ratio. As for the form of the conductive support, a support in the form of, for example, a drum, a sheet or a belt is used. Furthermore, an electroconductive support made of a metal material, on which an electrically conductive material having an appropriate resistance value is coated to control the electrical conductivity, surface property or the like or cover a defect, may be also used.

In the case where a metal material such as aluminum alloy is used as the conductive support, the metal material may be used after an anodic oxide film is applied thereto. When an anodic oxide film is applied, it is preferred to apply a sealing treatment by a known method.

The conductive support surface may be smooth or may be roughened by using a special cutting method or applying a polishing treatment. The roughening may be also achieved by mixing a particle having an appropriate particle diameter in the material constituting the conductive support. In addition, in order reduce the cost, it may be also possible to use a drawn pipe as it is without applying a cutting treatment.

<Undercoat Layer>

A undercoat layer may be provided between the conductive support and the later-described photosensitive layer so as to improve adhesive property, blocking property and the like. As the undercoat layer, for example, a resin or a resin having dispersed therein a particle such as metal oxide particle is used. The undercoat layer may be composed of a single layer or a plurality of layers.

Examples of the metal oxide particle used in the undercoat layer include a metal oxide particle containing one metal element, such as titanium oxide, aluminum oxide, silicon oxide, zirconium oxide, zinc oxide and iron oxide, and a metal oxide particle containing a plurality of metal elements, such as calcium titanate, strontium titanate and barium titanate. Of these metal oxide particles, one kind of a particle may be used alone, or a plurality of kinds of particles may be mixed and used. Among these metal oxide particles, titanium oxide and aluminum oxide are preferred, and titanium oxide is more preferred. The surface of the titanium oxide particle may be subjected to a treatment with an inorganic material such as tin oxide, aluminum oxide, antimony oxide, zirconium oxide and silicon oxide, or with an organic material such as stearic acid, polyol and silicone. As for the crystal form of the titanium oxide particle, any of rutile, anatase, brookite and amorphous may be used. Also, a plurality of crystal forms may be contained.

As for the particle diameter of the metal oxide particle, those having various particle diameters may be used but above all, in view of characteristics and liquid stability, the average primary particle diameter thereof is preferably from 10 to 100 nm, more preferably from 10 to 50 nm. This average primary particle diameter can be obtained using a TEM photograph or the like.

The undercoat layer is preferably formed in the form of a metal oxide particle being dispersed in a binder resin. The binder resin used in the undercoat layer includes an epoxy resin, a polyethylene resin, a polypropylene resin, an acrylic resin, a methacrylic resin, a polyamide resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a polyurethane resin, a polyacrylic resin, a polyacrylamide resin, a polyvinylpyrrolidone resin, a polyvinylpyridine resin, a water-soluble polyester resin, a cellulose ester resin such as nitrocellulose, a cellulose ether resin, casein, gelatin, a polyglutamic acid, starch, a starch acetate, an amino starch, an organic zirconium compound such as zirconium chelate compound and zirconium alkoxide compound, an organic titanyl compound such as titanyl chelate compound and titanyl alkoxide compound, a silane coupling agent, and other known binder resins. One of these binder resins may be used alone, or two or more thereof may be used in combination by employing an arbitrary combination and an arbitrary ratio. The binder resin may be also used in the form of being hardened together with a hardening agent. Among others, for example, an alcohol-soluble copolymerized polyamide or modified polyamide is preferred because this binder resin exhibits good dispersibility and coatability.

The use ratio of the inorganic particle to the binder resin used in the undercoat layer may be arbitrarily selected, but in view of stability and coatability of the liquid dispersion, the inorganic particle is preferably used in a ratio of usually from 10 to 500 mass % based on the binder resin.

The film thickness of the undercoat layer may be arbitrary as long as the effects of the present invention are not seriously impaired, but from the standpoint of enhancing electrical characteristics, intense exposure characteristics, image characteristics and repetition characteristics of the electrophotographic photoreceptor as well as coatability at the production, the film thickness is usually 0.01 μM or more, preferably 0.1 μm or more, and usually 30 μm or less, preferably 20 μm or less. In the undercoat layer, a known antioxidant and the like may be mixed. Also, for example, a pigment particle or a resin particle may be incorporated into the undercoat layer for the purpose of preventing an image defect or the like.

<Photosensitive Layer>

The photosensitive layer is formed on the above-described conductive support (in the case of providing the undercoat layer, on the undercoat layer). The photosensitive layer is a layer containing the charge transport substances represented by formulae (2) and (6) and the polycarbonate resin having a structural unit represented by the following formula (5), and the mode thereof includes a photosensitive layer having a single-layer structure in which a charge generating substance and a charge transport substance (including the charge transport substance of the present invention) are present in the same layer and these are dispersed in a binder resin (hereinafter, sometimes referred to as "single layer-type photosensitive layer"); and a function separation-type photosensitive layer having a laminate structure including two or more layers including a charge generation layer in which a charge generating substance is dispersed in a binder resin, and a charge transport layer in which a charge transport substance (including the charge transport substance of the present invention) is dispersed in a binder resin (hereinafter, sometimes referred to as "laminate-type photosensitive layer"). The photosensitive layer may be of either type.

The laminate-type photosensitive layer includes a forward laminate-type photosensitive layer in which a charge generation layer and a charge transport layer are stacked in this order from the conductive support side, and a reverse laminate-type photosensitive layer in which conversely, a charge transport layer and a charge generation layer are stacked in this order from the conductive support side. Either type can be employed, but a forward laminate-type photosensitive layer capable of exerting best balanced photoconductivity is preferred.

<Laminate-Type Photosensitive Layer>

[Charge Generation Layer]

The charge generation layer of the laminate-type photosensitive layer (function separation-type photosensitive layer) contains a charge generating substance and at the same time, usually contains a binder resin and other components which are used, if desired. Such a charge generation layer can be obtained, for example, by dissolving or dispersing a charge generating substance and a binder resin in a solvent or a dispersion medium to produce a coating solution, and applying and drying the coating solution, in the case of a forward laminate-type photosensitive layer, on a conductive support (when providing a undercoat layer, on the undercoat layer), and in the case of a reverse laminate-type photosensitive layer, on a charge transport layer.

The charge generating substance includes an inorganic photoconductive material such as selenium, its alloys and cadmium sulfide, and an organic photoconductive material such as organic pigment, but an organic photoconductive material is preferred, and an organic pigment is more preferred. Examples of the organic pigment include a phthalocyanine pigment, an azo pigment, a dithioketopyrrolopyrrole pigment, a squalene (squarylium) pigment, a quinacridone pigment, an indigo pigment, a perylene pigment, a polycyclic quinone pigment, an anthanthrone pigment, and a benzimidazole pigment. Among these, a phthalocyanine pigment or an azo pigment is preferred. In the case of using an organic pigment as the charge generating substance, the organic pigment is usually used in the form of a disperse layer in which fine particles of the organic pigment are bound by a binder resin of various types.

In the case of using a phthalocyanine pigment as the charge generating substance, specific examples of the phthalocyanine pigment which is used include a metal-free phthalocyanine, phthalocyanines in each crystal form to which a metal such as copper, indium, gallium, tin, titanium, zinc, vanadium, silicon and germanium, or an oxide, halide, hydroxide, alkoxide or another form thereof is coordinated, and phthalocyanine dimers using an oxygen atom or the like as a crosslinking atom. In particular, an X-type or τ-type metal-free phthalocyanine as a highly sensitive crystal form, a titanyl phthalocyanine (another name: oxytitanium phthalocyanine) such as A-type (another name: β-type), B-type (another name: α-type) and D-type (another name: Y-type), a vanadyl phthalocyanine, a chloroindium phthalocyanine, a hydroxyindium phthalocyanine, a chlorogallium phthalocyanine such as II-type, a hydroxygallium phthalocyanine such as V-type, a μ-oxo-gallium phthalocyanine dimer such as G-type and I-type, and a μ-oxo-aluminum phthalocyanine dimer such as II-type, are suitable.

Among these phthalocyanines, a metal phthalocyanine is preferred; a titanyl phthalocyanine of A-type (another name: β-type), B-type (another name: α-type) or D-type (Y-type) characterized in that the diffraction angle 20)(±0.2° of the powder X-ray diffraction exhibits a clear peak at 27.1° or 27.3°, a II-type chlorogallium phthalocyanine, a V-type hydroxygallium phthalocyanine, a hydroxygallium phthalocyanine having a strongest peak at 28.1°, a hydroxygallium phthalocyanine characterized in that the diffraction angle has no peak at 26.2° but has a clear peak at 28.1° and the half-value width W of 25.9° is $0.1° \leq W \leq 0.4°$, a G-type phthalocyanine dimer and the like are more preferred; and out of gallium-based phthalocyanines, a II-type chlorogallium phthalocyanine, a V-type hydroxygallium phthalocyanine, a hydroxygallium phthalocyanine having a strongest peat at 28.1°, a hydroxygallium phthalocyanine characterized in that the diffraction angle has no peak at 26.2° but has a clear peak at 28.1° and the half-value width W of 25.9° is $0.1° \leq W \leq 0.4°$, a G-type μ-oxo-gallium phthalocyanine dimer and the like are most preferred.

In the case of using a metal-free phthalocyanine compound or a metal-containing phthalocyanine compound as the charge generating substance, a photoreceptor exhibiting high sensitivity to laser light having a relatively long wavelength, for example, laser light having a wavelength of about 780 nm, is obtained. In the case of using an azo pigment such as monoazo, diazo and trisazo, a photoreceptor exhibiting sufficient sensitivity to white light, laser light having a wavelength of about 660 nm, or laser light having a relatively short wavelength (for example, laser light having a wavelength of 380 to 500 nm) can be obtained.

As the phthalocyanine compound, a single compound may be used, or a mixture of some compounds or a compound in a mixed crystal state may be used. Here, as for the mixed state of phthalocyanine compounds or crystal forms, a mixed state formed by mixing respective constituent elements afterward may be used, or a mixed state may be formed in the production/processing step of a phthalocyanine compound, such as synthesis, pigmentation and crystallization. Known examples of the treatment therefor include an acid paste treatment, a grinding treatment, and a solvent treatment. The method for forming a mixed crystal state includes a method where, as described in JP-A-10-48859, two kinds of crystals are mixed, then mechanically ground and amorphorized and thereafter converted into a specific crystal state by a solvent treatment.

On the other hand, in the case of using an azo pigment as the charge generating substance, conventionally known various azo pigments can be used as long as the pigment has sensitivity to a light source for light input, but various bisazo pigments and trisazo pigments are suitably used.

In the case where the organic pigment exemplified above is used as the charge generating substance, one kind of an organic pigment may be used, or two or more kinds of pigments may be mixed and used. In this case, two or more kinds of charge generating substances having spectral sensitivity characteristics in different spectral regions of visible region and near infrared region are preferably used in combination, and it is more preferred to use a disazo pigment, a trisazo pigment and a phthalocyanine pigment in combination.

The binder resin used in the charge generation layer constituting the laminate-type photosensitive layer is not particularly limited, but examples thereof include an insulating resin, for example, a polyvinylacetal-based resin such as polyvinylbutyral resin, polyvinylformal resin and partially acetalized polyvinylbutyral resin in which butyral is partially modified with formal, acetal or the like, a polyarylate resin, a polycarbonate resin, a polyester resin, a modified ether-based polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinylpyridine resin, a cellulose-based resin, a polyurethane resin, an epoxy resin, a silicone resin, a polyvinyl alcohol resin, a polyvinylpyrrolidone resin, casein, a vinyl chloride-vinyl acetate-based copolymer such as vinyl chloride-vinyl acetate copolymer, hydroxy-modified vinyl chloride-vinyl acetate copolymer, carboxyl-modified vinyl chloride-vinyl acetate copolymer and vinyl chloride-vinyl acetate-maleic anhydride copolymer, a styrene-butadiene copolymer, a vinylidene chloride-acrylonitrile copolymer, a styrene-alkyd resin, a silicon-alkyd resin, and a phenol-formaldehyde resin; and an organic photoconductive polymer such as poly-N-vinylcarbazole, polyvinylanthracene and polyvinylperylene. Any one of these binder resins may be used alone, or two or more kinds thereof may be used as a mixture in arbitrary combination.

The charge generation layer is specifically formed by dispersing a charge generating substance in a solution resulting from dissolving the above-described binder resin in an organic solvent, to prepare a coating solution and applying the coating solution on a conductive support (in the case of providing a undercoat layer, on the undercoat layer).

The solvent used for the preparation of the coating solution is not particularly limited as long as it dissolves the binder resin, but examples thereof include a saturated aliphatic solvent such as pentane, hexane, octane and nonane, an aromatic solvent such as toluene, xylene and anisole, a halogenated aromatic solvent such as chlorobenzene, dichlorobenzene and chloronaphthalene, an amide-based solvent such as dimethylformamide and N-methyl-2-pyrrolidone, an alcohol-based solvent such as methanol, ethanol, isopropanol, n-butanol and benzyl alcohol, aliphatic polyhydric alcohols such as glycerin and polyethylene glycol, a chain or cyclic ketone-based solvent such as acetone, cyclohexanone, methyl ethyl ketone and 4-methoxy-4-methyl-2-pentanone, an ester-based solvent such as methyl formate, ethyl acetate and n-butyl acetate, a halogenated hydrocarbon-based solvent such as methylene chloride, chloroform and 1,2-dichloroethane, a chain or cyclic ether-based solvent such as diethyl ether, dimethoxyethane, tetrahydrofuran, 1,4-dioxane, methyl cellosolve and ethyl cellosolve, an aprotic polar solvent such as acetonitrile, dimethylsulfoxide, sulfolane and hexamethylphosphoric acid triamide, a nitrogen-containing compound such as n-butylamine, isopropanolamine, diethylamine, triethanolamine, ethylenediamine, triethylenediamine and triethylamine, a mineral oil such as ligroin, and water. Any one of these solvents may be used alone, or two or more thereof may be used in combination. Incidentally, in the case of providing the above-described undercoat layer, a solvent that does not dissolve the undercoat layer is preferred.

In the charge generation layer, as for the blending ratio (mass ratio) between the binder resin and the charge generating substance, the ratio of the charge generating substance is usually 10 parts by mass or more, preferably 30 parts by mass or more, and usually 1,000 parts by mass or less, preferably 500 parts by mass or less, per 100 parts by mass of the binder resin. The film thickness of the charge generation layer is usually 0.1 μm or more, preferably 0.15 μm or more, and usually 10 μm or less, preferably 0.6 μm or less. If the ratio of the charge generating substance is too high, the coating solution may be reduced in the stability due to aggregation or the like of the charge generating substance, whereas if the ratio of the charge generating substance is too low, this may incur reduction in the sensitivity as a photoreceptor.

As the method for dispersing the charge generating substance, a known dispersion method such as ball mill dispersion method, attritor dispersion method and sand mill dispersion method may be employed. At this time, it is effective to pulverize the particle to a particle size of 0.5 μm or less, preferably 0.3 μm or less, more preferably 0.15 μm or less.

<Charge Transport Layer>

The charge transport layer of the laminate-type photoreceptor contains a charge transport substance, a binder resin, and other components which are used, if desired. The charge transport layer can be obtained specifically by dissolving or dispersing a charge transport substance or the like and a binder resin in a solvent to prepare a coating solution, and applying and drying the coating solution, in the case of a forward laminate-type photosensitive layer, on a charge generation layer and in the case of a reverse laminate-type photosensitive layer, on a conductive support (when providing a undercoat layer, on the undercoat layer).

As the charge transport substance, in addition to the charge transport substances represented by formulae (2) and (6), other known charge transport substances may be used in combination. In the case of using another charge transport substance in combination, the kind thereof is not particularly limited, but, for example, a carbazole derivative, a hydrazone compound, an aromatic amine derivative, an enamine derivative, a butadiene derivative, and a compound formed by bonding a plurality of these derivatives are preferred.

<Binder Resin>

The binder resin is used to secure the film strength. In the photoreceptor of the present invention, a polycarbonate resin having a structural unit represented by the following formula (5) is used as the binder resin in the same layer as the charge transport substances (2) and (6)

The amount of the polycarbonate resin having a structural unit represented by the following formula (5) is, in terms of the weight per 100 parts by weight of all binder resins, usually 10 parts by weight or more, preferably 50 parts by weight or more, more preferably 100 parts by weight.

(5)

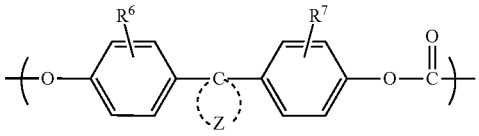

In formula (5), each of $R^6$ and $R^7$ represents a hydrogen atom or an alkyl group having a carbon number of 4 or less. Of these, a hydrogen atom and a methyl group are preferred. Z represents a cyclic aliphatic alkyl group having a total carbon number of 5 to 9 including the carbon atom of the bonding site. In view of production of the binder resin, the cyclic aliphatic alkyl group is preferably a 5- to 8-membered ring structure. The cyclic aliphatic alkyl group may have a substituent such as methyl group.

Preferred examples of formula (5) are illustrated below. Among these, in view of surface hardness, percentage elastic deformation and scratch resistance, (5)-4, (5)-5, (5)-6 and (5)-9 are preferred, and in view of crack resistance, (5)-4 is most preferred.

(5)-1

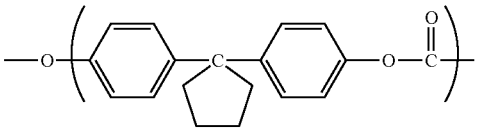

(5)-2

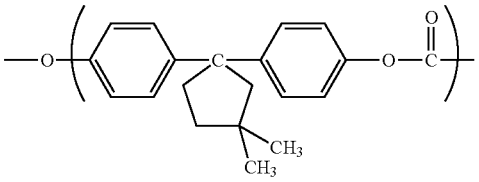

(5)-3

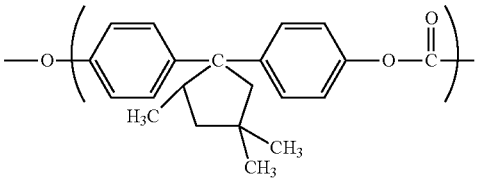

(5)-4

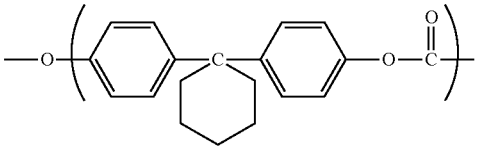

(5)-5

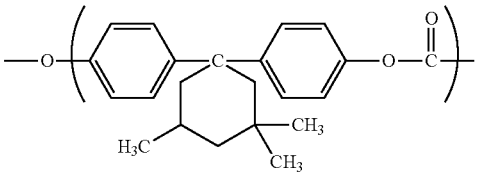

(5)-6

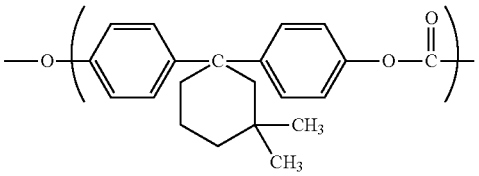

(5)-7

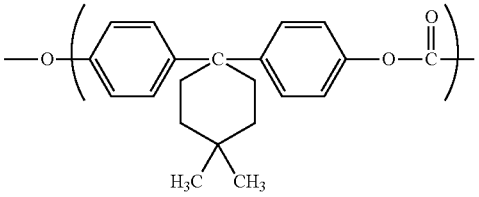

-continued (5)-8

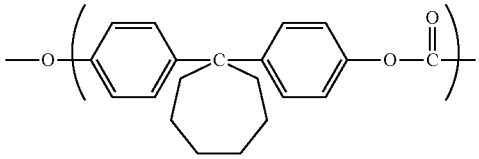

(5)-9

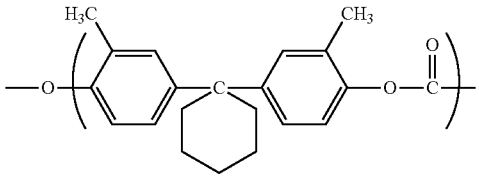

The polycarbonate resin having a structural unit represented by formula (5) has appropriate solubility and rigidity as well as a high glass transition temperature, exhibits very good compatibility with the charge transport substances represented by formulae (2) and (6), and allows for near molecular level dispersion of the charge transport material. The charge transport material represented by formula (6) is insufficient in view of crack resistance and is readily eluted, for example, in an oil component derived from a contact member such as charging roller. On the other hand, the charge transport material represented by formula (2) is high in the planarity and stacking property of molecule and insufficient in the compatibility with the polycarbonate resin having a structural unit represented by formula (5) and may precipitate in the photosensitive layer but is excellent in the crack resistance. For this reason, the charge transport material represented by formula (2) and the charge transport material represented by formula (6) are used as a mixture, and these two materials compensate for each other's weaknesses, for example, by suppressing crystal precipitation of the charge transport material represented by formula (2) and at the same time, reducing the solubility of the charge transport material represented by formula (6), whereby the crack resistance is improved. Furthermore, also in view of electrical characteristics, despite different chemical structures from each other, these charge transport materials have a similar highest occupied molecular orbital (HOMO) energy and therefore, a structural trap such as dimer trap (a stable structure formed by a homodimer to act as a charge transport trap) that is formed when each of those charge transport materials is used alone, is prevented from being formed, and the crack resistance is more improved than in single use. In addition, the polycarbonate resin having a structural unite represented by formula (5) is not only rigid but also has appropriate structural flexibility attributable to boat-chair tautomerism of a cycloalkyl group, for example, a cyclohexyl group, and therefore, this resin is considered to synergistically exert its effect on the crack resistance while keeping the compatibility with the charge transport material.

Incidentally, the polycarbonate for use in the present invention may be a homopolymer composed of a single unit represented by formula (5) or may be a block or random copolymer with other bisphenol units. Examples of the bisphenol unit which may be copolymerized are illustrated below. The copolymerization ratio may be arbitrary as long as the performance of the unit represented by formula (5) is not impaired, but the proportion of formula (5) is preferably 50 wt % or more, more preferably 70 wt % or more, based on the total weight of the polycarbonate resin.

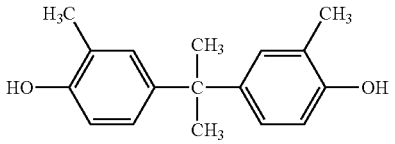

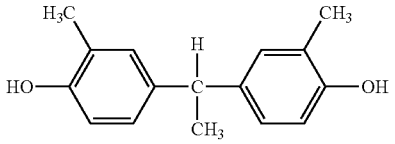

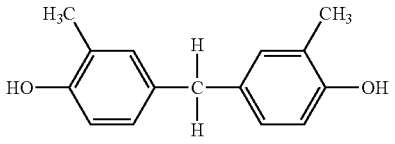

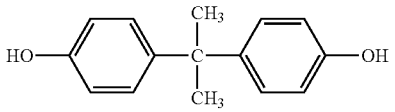

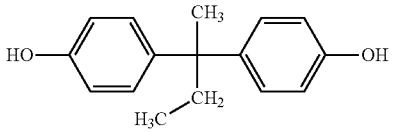

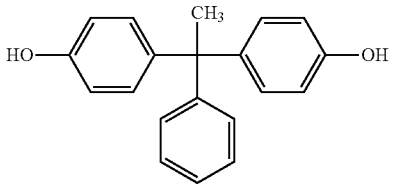

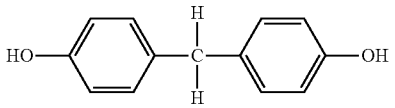

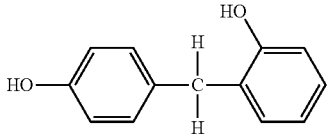

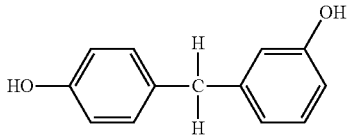

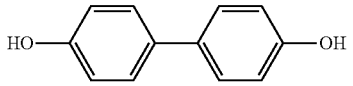

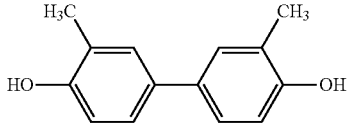

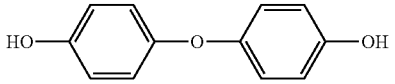

-continued

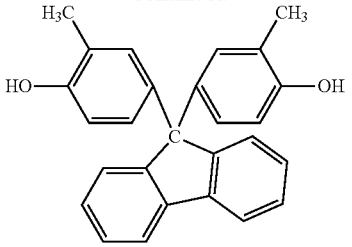

The binder resin for use in the present invention may have an arbitrary viscosity average molecular weight as long as the effects of the present invention are not seriously impaired, but the viscosity average molecular weight is preferably 10,000 or more, more preferably 20,000 or more, and the upper limit thereof is preferably 100,000 or less, more preferably 70,000 or less. If the viscosity average molecular weight is too small, the photosensitive layer may lack the mechanical strength, whereas if the viscosity average molecular weight is too large, the viscosity of the coating solution for photosensitive layer formation is excessively high and the productivity may be reduced. Incidentally, the viscosity average molecular weight can be measured, for example, using an Ubbelohde capillary viscometer or the like by the method described in examples.

In addition to the above-described polycarbonate resin, other binder resins may be mixed and used as long as the effects of the present invention are not impaired. Examples of the binder resin which may be mixed and used include a polyester resin, a polyarylate resin, a butadiene resin, a styrene resin, a vinyl acetate resin, a vinyl chloride resin, an acrylic acid ester resin, a methacrylic acid ester resin, a vinyl alcohol resin, a polymer or copolymer of a vinyl compound such as ethyl vinyl ether, a polyvinylbutyral resin, a polyvinylformal resin, a partially modified polyvinyl acetal, a polyamide resin, a polyurethane resin, a cellulose ester resin, a phenoxy resin, a silicon resin, a silicon-alkyd resin, and a poly-N-vinylcarbazole resin.

The film thickness of the charge transport layer is not particularly limited, but in view of long life and image stability as well as charging stability, the film thickness is usually 5 μm or more, preferably 10 μm or more, and usually 50 μm or less, preferably 45 μm or less, more preferably 30 μm or less, and from the standpoint of achieving high resolution, most preferably 25 μm or less.

<Single Layer-Type Photosensitive Layer>

The single layer-type photosensitive layer is formed using, in addition to a charge generating substance and a charge transport substance, a binder resin for securing the film strength, similarly to the charge transport layer of the laminate-type photoreceptor. Specifically, the single layer-type photosensitive layer can be obtained by dissolving or dispersing a charge generating substance, a transport substance and various binder resins in a solvent to prepare a coating solution, and applying and drying the coating solution on a conductive support (in the case of providing a undercoat layer, on the undercoat layer).

The kinds of the charge transport substance and binder resin and the use ratio therebetween are the same as those described for the charge transport layer of the laminate-type photoreceptor. A charge generating substance is further dispersed in a charge transport medium composed of these charge transport substance and binder resin.

The charge generating substance which can be used is the same as that described for the charge generation layer of the laminate-type photoreceptor. However, in the case of the photosensitive layer of the single layer-type photoreceptor, the particle diameter of the charge generating substance must be sufficiently small. Specifically, the particle diameter is usually 1 μm or less, preferably 0.5 μm or less.

Also, as for the use ratio between the binder resin and the charge generating substance in the single layer-type photosensitive layer, the ratio of the charge generating substance is usually 0.1 parts by mass or more, preferably 1 part by mass or more, and usually 30 parts by mass or less, preferably 10 parts by mass or less, per 100 parts by mass of the binder resin.

The film thickness of the single layer-type photosensitive layer is usually 5 μm or more, preferably 10 μm or more, and usually 100 μm or less, preferably 50 μm or less.

<Other Additives>

In both the laminate-type photoreceptor and the single layer-type photoreceptor, for the purpose of enhancing the deposition property, flexibility, coatability, contamination resistance, gas resistance, light resistance and the like, known additives such as antioxidant, plasticizer, ultraviolet absorber, electron-withdrawing compound, leveling agent and visible light-shielding agent may be incorporated into the photosensitive layer or each layer constituting the photosensitive layer.

<Other Functional Layers>

Also, in both the laminate-type photoreceptor and the single layer-type photoreceptor, the photosensitive layer formed by the above-described procedure may be caused to serve as the uppermost layer, that is, the surface layer, but another layer may be further provided thereon to serve as the surface layer. For example, a protective layer may be provided for the purposes of protecting the photosensitive layer against wear damage or preventing or keeping the photosensitive layer from deterioration due to a discharge product or the like generated, for example, from a charging device.

The electrical resistance of the protective layer is usually from $10^9$ to $10^{14}$ Ω·cm. If the electrical resistance exceeds this range, the residual potential rises to cause a lot of fogging on the image, whereas if the electrical resistance is less than the range above, blurring of the image and reduction in the resolution may be brought about. In addition, the protective layer must be configured not to substantially inhibit passing of irradiation light during imagewise exposure.

For the purpose of, for example, reducing the friction resistance or abrasion on the photoreceptor surface or increasing the transfer efficiency of toner from the photoreceptor to a transfer belt and paper, a fluorine-based resin, a silicon resin, a polyethylene resin or the like, a particle made of such a resin, or an inorganic compound particle may be incorporated into the surface layer. Alternatively, a layer containing such a resin or particle may be newly formed as the surface layer.

<Method for Forming Each Layer>

A coating solution obtained by dissolving or dispersing the substances to be incorporated into the layer in a solvent is coated on a conductive support by a known method such as such as dip coating, spray coating, nozzle coating, bar coating, roll coating and blade coating and dried, and this process is repeated for every sequential layer, whereby the above-described layers constituting the photoreceptor are formed.

The solvent or dispersion medium used for the preparation of the coating solution is not particularly limited, but specific examples thereof include alcohols such as methanol, ethanol, propanol and 2-methoxyethanol, ethers such as tetrahydrofuran, 1,4-dioxane and dimethoxyethane, esters such as methyl formate and ethyl acetate, ketones such as acetone, methyl ethyl ketone, cyclohexanone and 4-methoxy-4-methyl-2-pentanone, aromatic hydrocarbons such as benzene, toluene and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane and trichloroethylene, nitrogen-containing compounds such as n-butylamine, isopropanolamine, diethylamine, triethanolamine, ethylenediamine and triethylenediamine, and aprotic polar solvents such as acetonitrile, N-methylpyrrolidone, N,N-dimethylformamide and dimethylsulfoxide. One of these solvents may be used alone, or any two or more kinds thereof may be used in combination by employing an arbitrary combination.

The amount of the solvent or dispersion medium used is not particularly limited but is preferably adjusted such that the physical properties of the coating solution, such as solid content concentration and viscosity, fall in desired ranges by taking into consideration the intended use of each layer and the property of the solvent or dispersion medium.

For example, in the case of a single layer-type photoreceptor and the charge transport layer of a laminate-type photoreceptor, the solid content concentration of the coating solution is usually 5 mass % or more, preferably 10 mass % or more, and usually 40 mass % or less, preferably 35 mass % or less. Also, the viscosity of the coating solution at the in-use temperature is usually 10 mPa·s or more, preferably 50 mPa·s or more, and usually 500 mPa·s or less, preferably 400 mPa·s or less.

In the case of the charge generation layer of a laminate-type photoreceptor, the solid content concentration of the coating solution is usually 0.1 mass % or more, preferably 1 mass % or more, and usually 15 mass % or less, preferably 10 mass % or less. Also, the viscosity of the coating solution at the in-use temperature is usually 0.01 mPa·s or more, preferably 0.1 mPa·s or more, and usually 20 mPa·s or less, preferably 10 mPa·s or less.

Examples of the method for applying the coating solution include a dip coating method, a spray coating method, a spinner coating method, a bead coating method, a wire bar coating method, a blade coating method, a roller coating method, an air knife coating method, and a curtain coating method, but other known coating methods may be also used.

As for drying, the coating solution is preferably dried to touch at room temperature and then heat-dried at a temperature of usually from 30 to 200° C. for 1 minute to 2 hours statically or by blowing air. Also, the heating temperature may be constant or the heating may be performed while changing the temperature during drying.

<<Image Forming Apparatus>>

An embodiment of the image forming apparatus (image forming apparatus of the present invention) using the electrophotographic photoreceptor of the present invention is described below by referring to FIG. 1 which illustrates the configuration of main parts of the apparatus. However, the embodiment is not limited to the following description, and the present invention can be performed by arbitrarily making modifications therein without departing from the purport of the present invention.

As shown in FIG. 1, the image forming apparatus is configured to include an electrophotographic photoreceptor 1, a charging device 2, an exposure device 3, and a developing device 4, and furthermore, a transfer device 5, a cleaning device 6 and a fixing device 7 are provided, if desired.

The electrophotographic photoreceptor 1 is not particularly limited as long as it is the above-described electrophotographic photoreceptor of the present invention, but FIG. 1 shows, as an example thereof, a drum-shaped photoreceptor in which the photosensitive layer described above is formed on the surface of a cylindrical conductive support. Along the outer peripheral surface of the electrophotographic photoreceptor 1, the charging device 2, the exposure device 3, the developing device 4, the transfer device 5, and the cleaning device 6 are disposed.

The charging device 2 serves to charge the electrophotographic photoreceptor 1 and evenly charges the surface of the electrophotographic photoreceptor 1 to a given potential. Examples of the charging device which is often used include a corona charging device such as corotron and scorotron, and a direct charging device (contact-type charging device) in which a voltage-applied direct charging member is put into contact with the surface of the photoreceptor for charging. Examples of the direct charging device include a charging roller and a charging brush. Incidentally, in FIG. 1, a roller-type charging device (charging roller) is shown as one example of the charging device 2. As the direct charging method, both of charging involving atmospheric discharge and injection charging involving no atmospheric discharge can be used. The voltage applied at the charging may be a direct current voltage alone, or a direct current voltage may be used by superposing an alternate current voltage thereon.

The exposure device 3 is not particularly limited in its kind as long as it can expose the electrophotographic photoreceptor 1 and form an electrostatic latent image on the photosensitive surface of the electrophotographic photoreceptor 1. Specific examples thereof include a halogen lamp, a fluorescent lamp, a laser such as semiconductor laser and He—Ne laser, and LED. Also, the exposure may be performed by a photoreceptor internal exposure system. The light at the exposure is arbitrary, but the exposure may be performed, for example, to monochromatic light at a wavelength of 780 nm, monochromatic light slightly on the short wavelength side at a wavelength of 600 to 700 nm, or monochromatic light having a short wavelength at a wavelength of 380 to 500 nm.

The developing device 4 is not particularly limited in its kind, and an arbitrary device, for example, a dry development system such as cascade development, one-component insulating toner development, one-component conductive toner development and two-component magnetic brush development, or a wet development system, can be used. In FIG. 1, the developing device 4 includes a development tank 41, an agitator 42, a feed roller 43, a developing roller 44 and a regulating member 45 and is configured to store a toner T inside the development tank 41. If desired, a replenisher device (not shown) for replenishing the toner T may be attached to the developing device 4. The replenisher device is configured to enable replenishment of the toner T from a container such as bottle and cartridge.

The feed roller 43 is formed of an electrically conductive sponge or the like. The developing roller 44 is, for example, a roller made of a metal such as iron, stainless steel, aluminum and nickel, or a resin roller obtained by coating such a metal roller with a silicon resin, a urethane resin, a fluororesin or the like. If desired, the surface of the developing roller 44 may be subjected to smoothing or roughening processing.

The developing roller 44 is disposed between the electrophotographic photoreceptor 1 and the feed roller 43 and is abutted with each of the electrophotographic photoreceptor 1 and the feed roller 43. The feed roller 43 and the developing roller 44 are rotated each by a rotation driving mechanism (not shown). The feed roller 43 carries the stored toner T and feeds it to the developing roller 44. The developing roller 44 carries the toner T fed by the feed roller 43 and brings it into contact with the surface of the electrophotographic photoreceptor 1. This mechanism is the contact developing system, and in the present invention, the contact developing system is preferable.

The regulating member 45 is formed by a resin blade made of a silicone resin, a urethane resin or the like, a metal blade made of stainless steel, aluminum, copper, brass, phosphor bronze or the like, or a blade produced by coating such a metal blade with a resin. The regulating member 45 is abutted with the developing roller 44 and is pushed toward the developing roller 44 by a spring or the like under a predetermined pressure (the blade linear pressure is generally from 5 to 500 g/cm). If desired, the regulating member 45 may be designed to have a function of charging the toner T by frictional charging with the toner T.

The agitator 42 is rotated by a rotation driving mechanism and while agitating the toner T, conveys the toner T toward the feed roller 43 side. A plurality of agitators 42 differing in the blade shape, the size or the like may be provided.

The toner T may be of its type and in addition to a powder toner, for example, a polymerized toner produced using a suspension polymerization method, an emulsification polymerization method or the like may be used. Above all, in the case of using a polymerized toner, a small-diameter toner having a particle diameter of approximately from 4 to 8 μm is preferred. As for the shape of the toner particle, various toner particles from a substantially spherical shape to a potato shape deviating from a sphere can be used. The polymerized toner is excellent in charging uniformity and transfer property and is suitably used for achieving a high image quality.

The transfer device 5 is not particularly limited in its kind, and a device employing an arbitrary system, for example, an electrostatic transfer method, a pressure transfer method or an adhesive transfer method, such as corona transfer, roller transfer and belt transfer, may be used. Here, the transfer device 5 shall include a transfer charger, a transfer roller, a transfer belt and the like all disposed to face the electrophotographic photoreceptor 1. The transfer device 5 is applied with a predetermined voltage value (transfer voltage) having a polarity opposite the charge potential of the toner T and transfers the toner image formed on the electrophotographic photoreceptor 1 onto recording paper (paper, medium) P.

The cleaning device 6 is not particularly limited, and an arbitrary cleaning device such as brush cleaner, magnetic brush cleaner, electrostatic brush cleaner, magnetic roller cleaner and blade cleaner may be used. The cleaning device 6 scrapes away the residual toner adhering to the photoreceptor 1 by a cleaning member to collect the residual toner. In case where no or little toner remains on the photoreceptor surface, the cleaning device 6 may be omitted.

The fixing device 7 is composed of an upper fixing member (fixing roller) 71 and a lower fixing member (fixing roller) 72, and a heating device 73 is provided inside the fixing member 71 or 72. Incidentally, FIG. 1 shows an example where a heating device 73 is provided inside the upper fixing member 71. For each of the upper and lower fixing members 71 and 72, a known heat-fixing member, for example, a fixing roller obtained by coating an original metal pipe made of stainless steel, aluminum or the like with silicone rubber, a fixing roller further coated with Teflon resin, or a fixing sheet, can be used. Furthermore, the fixing members 71 and 72 may be configured to supply a release agent such as silicone oil for enhancing the releasability or may be configured to forcedly apply a pressure by a spring or the like.

The toner transferred onto the recording paper P is thermally heated up to a state of the toner melted in the course of passing between the upper fixing member 71 and the lower fixing member 72 each heated at a predetermined temperature and after passing therebetween, the toner is cooled and fixed on the recording paper P.

Here, the fixing device is also not particularly limited in its kind, and as well as the fixing device used above, a fixing device employing an arbitrary system such as heat roller fixing, flash fixing, oven fixing and pressure fixing can be provided.

In the thus-configured electrophotographic apparatus, image recording is performed as follows. That is, first, the surface (photosensitive surface) of the photoreceptor 1 is charged to a predetermined potential (for example, −600 V) by the charging device 2. At this time, the surface may be charged by a direct current voltage or may be charged by superposing an alternate current voltage on a direct current voltage.

Subsequently, the photosensitive surface of the charged photoreceptor 1 is exposed by the exposure device 3 according to the image to be recorded, thereby forming an electrostatic latent image on the photosensitive surface. The electrostatic latent image formed on the photosensitive surface of the photoreceptor 1 is then developed by the developing device 4.

In the developing device 4, the toner T fed by the feed roller 43 is regulated to a thin layer by the regulating member (developing blade) 45, frictionally charged to a predetermined polarity (here, the same polarity as the charging potential of the photoreceptor 1, that is, negative polarity), conveyed on the developing roller 44, and brought into contact with the surface of the photoreceptor 1.

When the electrically charged toner T carried on the developing roller 44 comes into contact with the photoreceptor 1 surface, a toner image corresponding to the electrostatic latent image is formed on the photosensitive surface of the photoreceptor 1. This toner image is then transferred onto the recording paper P by the transfer device 5. Thereafter, the toner not transferred but remaining on the photosensitive surface of the photoreceptor 1 is removed by the cleaning device 6.

After transferring the toner image onto the recording paper P, the paper is passed through the fixing device 7 to heat-fix the toner image on the recording paper P, whereby a final image is obtained.

Incidentally, in addition to the above-described configuration, the image forming apparatus may have a configuration where, for example, a charge erasing step can be performed. The charge erasing step is a step of exposing the electrophotographic photoreceptor and thereby erasing the charge of the electrophotographic photoreceptor. As for the charge erasing device, a fluorescent lamp, LED or the like is used. Also, the light used in the charge erasing step is, in many cases, light having an intensity of, in terms of the exposure energy, 3 times or more that of the exposure light.

The image forming apparatus may also have a modified configuration, for example, may be configured to allow for steps such as pre-exposure step and auxiliary charging step, may be configured to perform offset printing, or may be configured in a full-color tandem system using a plurality of kinds of toners.

Here, the photoreceptor 1 may be configured as an integrated cartridge (hereinafter, sometimes referred to as "electrophotographic photoreceptor cartridge") by combining one member or two or more members out of the charging device 2, the exposure device 3, the developing device 4, the transfer device 5, the cleaning device 6 and the fixing device 7, and the electrophotographic photoreceptor cartridge may be configured to be removable from the main body of the electrophotographic apparatus such as copying machine and laser beam printer. In this case, for example, when the electrophotographic photoreceptor 1 or other members are deteriorated, the electrophotographic photoreceptor cartridge is removed from the main body of the image forming apparatus, and another new electrophotographic photoreceptor cartridge is attached to the main body of the image forming device, whereby the maintenance/management of the image forming device is facilitated.

EXAMPLES

The embodiment of the present invention is described in greater detail below by referring to Examples. However, the following Examples are given for explaining the present invention in detail, and the present invention is not limited to these Examples but can be performed by arbitrarily making modifications therein without departing from the purport of the present invention. In the following Examples and Comparative Examples, unless otherwise indicated, the "parts" indicates "parts by weight" or "parts by mass".

Example 1

Production of Coating Solution for Undercoat Layer Formation

Rutile titanium oxide having an average primary particle diameter of 40 nm ("TTO55N", produced by Ishihara Sangyo Kaisha, Ltd.) and methyldimethoxysilane ("TSL8117", produced by Toshiba Silicones) in an amount of 3 mass % based on the titanium oxide were mixed in a Henschel mixer, and the obtained surface-treated titanium oxide was dispersed in a mixed solvent of methanol/1-propanol at a mass ratio of 7/3 by a ball mill to make a dispersion slurry of surface-treated titanium oxide. This dispersion slurry, a mixed solvent of methanol/1-propanol/toluene, and a pellet of a copolymerized polyamide composed of c-caprolactam [the compound represented by the following formula (A)]/bis(4-amino-3-methylcyclohexyl)methane [the compound represented by the following formula (B)]/hexamethylenediamine [the compound represented by the following formula (C)]/decamethylenedicarboxylic acid [the compound represented by the following formula (D)]/octadecamethylenedicarboxylic acid [the compound represented by the following formula (E)] in a compositional molar ratio of 60%/15%/5%/15%/5% were stirred and mixed under heating to dissolve the polyamide pellet, and the obtained solution was subjected to an ultrasonic dispersion treatment to produce a coating solution for undercoat layer formation containing surface-treated titanium oxide/copolymerized polyamide in a weight ratio of 3/1 and having a solid content concentration of 18.0%, in which the weight ratio of methanol/1-propanol/toluene was 7/1/2.

A

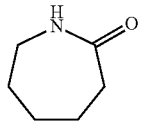

B

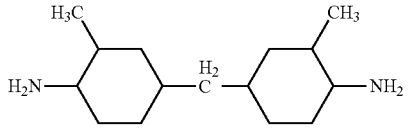

C

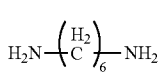

-continued

D

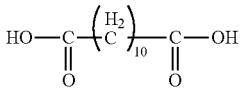

E

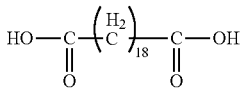

<Production of Coating Solution for Charge Generation Layer Formation>

20 Parts of Y-type (another name: D-type) oxytitanium phthalocyanine exhibiting a strong diffraction peak at a Bragg angle (2θ±0.2) of 27.3° in X-ray diffraction by CuKα ray was mixed as a charge generating substance with 280 parts of 1,2-dimethoxyethane, and the mixture was ground in a sand grinding mill for 1 hour to perform a pulverization/dispersion treatment. This pulverization-treated solution was mixed with a binder solution obtained by dissolving 10 parts of polyvinylbutyral ("Denka Butyral" #6000C, trade name, produced by Denki Kagaku Kogyo K.K.) in a mixed solution of 255 parts of 1,2-dimethoxyethane and 85 parts of 4-methoxy-4-methyl-2-pentanone and with 230 parts of 1,2-dimethoxyethane to prepare a coating solution for charge generation layer formation.

<Production of Coating Solution for Charge Transport Layer Formation>

100 Parts of a polycarbonate resin having a repeating structural unit of (5)-4 (viscosity average molecular weight: 40,000), 40 parts of Compound (1)-2 and 40 parts of Compound (2)-5 as charge transport substances, and 0.05 parts of silicone oil (KF96, trade name, produced by Shin-Etsu Silicone) were dissolved in 520 parts of a mixed solvent of tetrahydrofuran (hereinafter, sometimes simply referred to as THF)/toluene (8/2 (by weight)) to prepare a coating solution for charge transport layer formation.

<Production of Photoreceptor>

On a polyethylene terephthalate sheet having deposited on the surface thereof aluminum, the coating solution for undercoat layer formation obtained above was coated by a wire bar to have a film thickness of about 1.3 μm after drying and dried at room temperature to provide a undercoat layer.

On this undercoat layer, the coating solution for charge generation layer formation obtained above was coated by a wire bar to have a film thickness of about 0.3 μm after drying and dried at room temperature to provide a charge generation layer.

On this charge generation layer, the coating solution for charge transport layer formation obtained above was coated by an applicator to have a film thickness of about 25 μm after drying and dried at 125° C. for 20 minutes to produce a photoreceptor.

<Electrical Characteristic Test>

Using an apparatus for evaluating electrophotographic characteristics manufactured in accordance with the measurement standards of the Society of Electrophotography of Japan (described in *Zoku Denshi Shashin Gijutsu no Kiso to Oyo* (*Basic and Application of Electrophotographic Technology, Part II*), compiled by the Society of Electrophotography of Japan, Corona Publishing Co., Ltd., pp. 404-405), the sheet-like photoreceptor obtained above was wound around an aluminum-made cylinder having a diameter of 80 mm and after attaching a grounding wire, charged to give an initial surface potential of −700 V, and the surface potential (bright potential; referred to as VL) when exposed to 0.8 μJ/cm$^2$ of 780-nm monochromatic light into which light of a halogen lamp was converted through an interference filter, was determined. The time from exposure to potential measurement was set to 60 ms. The measurement was performed in an environment of 25° C. and 50% RH (referred to as NN) and in an environment of 5° C. and 10% RH (referred to as LL). When the absolute value of VL is large, this indicates that the responsivity is poor. The results are shown in Table 1.

<Crack Resistance Test>

The photoreceptor sheet was cut into a strip-like fragment of 1 cm×20 cm and after coating a hydrocarbon-based solvent (Isopar L, trade name, produced by Exxon Chemical) on the entire surface, left standing overnight. The next day, the solvent above was again coated and by pulling the photoreceptor fragment in the long side direction with a force of about 33 N while grasping both ends of the photoreceptor fragment by a tensile tester (TENSILON RTM-100, manufactured by ORIENTEC), the cracking in the photosensitive layer of the photoreceptor was observed. In so doing, the time until a crack of a size of about half the width (0.5 cm) was generated in the short side direction of the photoreceptor fragment was measured. However, when cracking was not generated even after 180 seconds, the observation was not continued any more (as the data, "180 seconds" is used). The measurement was performed twice, and the average value thereof was taken. As the time until the crack was generated is longer, the crack resistance is higher. The results are shown in Table 1. Incidentally, the component such as plasticizer, which transfers to the photoreceptor during contact with a charging roller or the like and gives rise to cracking, differs from the above-described hydrocarbon-based solvent but exhibits a similar behavior and therefore, this test is considered to be proper as a model test. Also, when the test is performed as an acceleration test by applying a given tension to the photosensitive layer to shorten the time until cracking occurs, the degree of crack resistance can be quantitatively assessed.

Example 2

A photoreceptor was produced and evaluated in the same manner as in Example 1 except for changing the charge transport substance (2)-5 to (2)-8 in Example 1. The results are shown in Table 1.

Example 3

A photoreceptor was produced and evaluated in the same manner as in Example 1 except for changing the charge transport substance (2)-5 to a mixture of (2)-10, 11 and 12 (weight ratio: 25:50:25) in Example 1. The results are shown in Table 1.

Example 4

A photoreceptor was produced and evaluated in the same manner as in Example 1 except for changing the charge transport substance (2)-5 to a mixture of (2)-16 and 17 (weight ratio: 50:50) in Example 1. The results are shown in Table 1.

Example 5

A photoreceptor was produced and evaluated in the same manner as in Example 1 except for changing the charge transport substance (1)-2 to (1)-4 in Example 1. The results are shown in Table 1.

Example 6

A photoreceptor was produced and evaluated in the same manner as in Example 3 except for changing the charge transport substance (1)-2 to (1)-4 in Example 3. The results are shown in Table 1.

Comparative Example 1

A photoreceptor was produced and evaluated in the same manner as in Example 1 except for changing the charge transport substance (2)-5 to the following (A) in Example 1. The results are shown in Table 1.

(A)

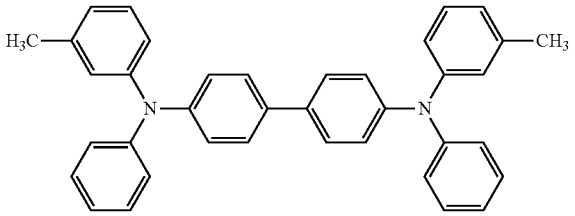

Comparative Example 2

A photoreceptor was produced and evaluated in the same manner as in Example 1 except for changing the charge transport substance (2)-5 to the following (B) in Example 1. The results are shown in Table 1.

(B)

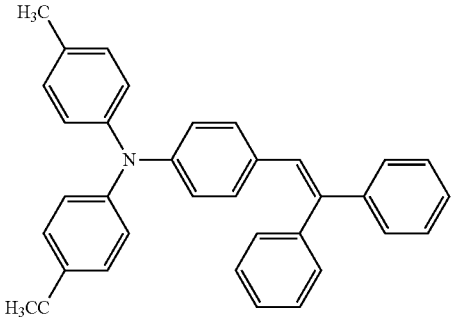

Comparative Example 3

A photoreceptor was produced and evaluated in the same manner as in Example 1 except for changing the charge transport substance (2)-5 to the following (C) in Example 1. The results are shown in Table 1.

(C)

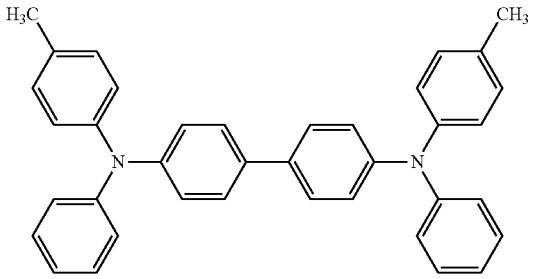

Comparative Example 4

A photoreceptor was produced and evaluated in the same manner as in Example 1 except for changing the charge transport substance (2)-5 to the following (D) in Example 1. The results are shown in Table 1.

(D)

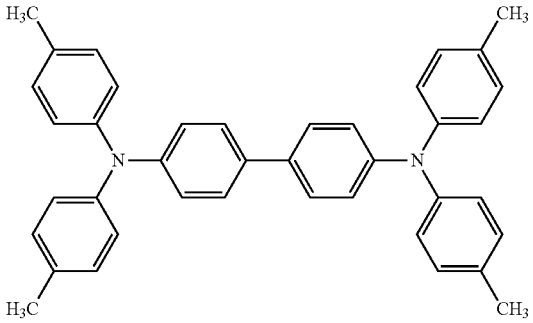

Comparative Example 5

A photoreceptor was produced and evaluated in the same manner as in Example 1 except for changing the charge transport substance (2)-5 to the following (E) in Example 1. The results are shown in Table 1.

(E)

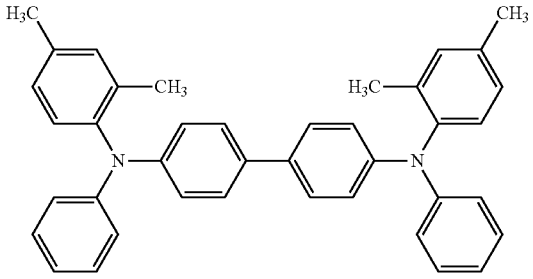

Comparative Example 6

A photoreceptor was produced and evaluated in the same manner as in Comparative Example 3 except for changing the binder resin (5)-4 to a resin composed of a structural unit represented the following (X) (viscosity average molecular weight: 35,000, terephthalic acid:isophthalic acid=50:50) in Comparative Example 3. The results are shown in Table 1.

(X)

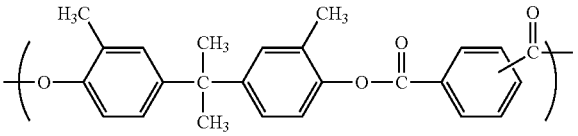

Comparative Example 7

A photoreceptor was produced and evaluated in the same manner as in Comparative Example 6 except for changing the charge transport substance (2)-1 to (D) in Comparative Example 6. The results are shown in Table 1.

Comparative Example 8

A photoreceptor was produced and evaluated in the same manner as in Comparative Example 6 except for changing the charge transport substance (2)-1 to (E) in Comparative Example 6. The results are shown in Table 1.

Comparative Example 9

A photoreceptor was produced and evaluated in the same manner as in Comparative Example 6 except for changing the charge transport substance (2)-1 to (2)-5 in Comparative Example 6. The results are shown in Table 1.

Comparative Example 10

A photoreceptor was produced and evaluated in the same manner as in Example 1 except for using 80 parts of Compound (1)-2 as the charge transport substance and not using Compound (2)-5 in Example 1. The results are shown in Table 1.

Comparative Example 11

A photoreceptor was produced and evaluated in the same manner as in Example 1 except for using 80 parts of Compound (2)-5 as the charge transport substance and not using Compound (1)-2 in Example 1. In the charge transport layer, a crystal of the charge transport substance (2)-5 was precipitated to cause whitening. The results are shown in Table 1.

Comparative Example 12

A photoreceptor was produced and evaluated in the same manner as in Example 1 except for changing the binder resin (5)-4 to a resin composed of a structural unit represented the following (Y) (viscosity average molecular weight: 30,000) in Example 1. The results are shown in Table 1.

(Y)

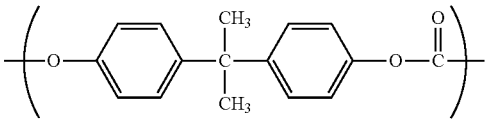

Comparative Example 13

A photoreceptor was produced and evaluated in the same manner as in Example 1 except for changing the binder resin (5)-4 to a resin composed of a structural unit represented the following (Z) (viscosity average molecular weight: 50,000) in Example 1. The results are shown in Table 1.

(Z)

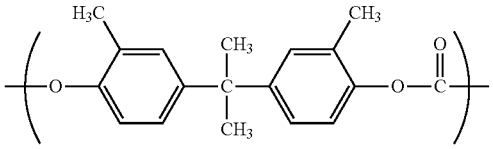

Comparative Example 14

A photoreceptor was produced and evaluated in the same manner as in Example 1 except for changing the charge transport substance (1)-2 to the following (F) in Example 1. The results are shown in Table 1.

(F)

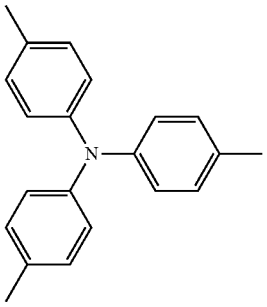

TABLE 1

| | Charge Transport Substance (1) | Charge Transport Substance (2) | Binder Resin | VL:NN (−V) | VL:LL (−V) | Time Until Generation of Cracking (sec) |
|---|---|---|---|---|---|---|
| Example 1 | (1)-2 | (2)-5 | (5)-4 | 55 | 101 | 56 |
| Example 2 | (1)-2 | (2)-8 | (5)-4 | 58 | 103 | 54 |
| Example 3 | (1)-2 | (2)-10, 11 and 12 | (5)-4 | 55 | 98 | 40 |
| Example 4 | (1)-2 | (2)-16 and 17 | (5)-4 | 53 | 97 | 43 |
| Example 5 | (1)-4 | (2)-5 | (5)-4 | 48 | 92 | 67 |
| Example 6 | (1)-4 | (2)-10, 11 and 12 | (5)-4 | 49 | 89 | 46 |
| Comparative Example 1 | (1)-2 | (A) | (5)-4 | 44 | 99 | 28 |

TABLE 1-continued

| | Charge Transport Substance (1) | Charge Transport Substance (2) | Binder Resin | VL:NN (−V) | VL:LL (−V) | Time Until Generation of Cracking (sec) |
|---|---|---|---|---|---|---|
| Comparative Example 2 | (1)-2 | (B) | (5)-4 | 66 | 110 | 9 |
| Comparative Example 3 | (1)-2 | (C) | (5)-4 | 44 | 90 | 22 |
| Comparative Example 4 | (1)-2 | (D) | (5)-4 | 43 | 99 | 30 |
| Comparative Example 5 | (1)-2 | (E) | (5)-4 | 52 | 114 | 21 |
| Comparative Example 6 | (1)-2 | (C) | (X) | 101 | 217 | 61 |
| Comparative Example 7 | (1)-2 | (D) | (X) | 129 | 271 | 46 |
| Comparative Example 8 | (1)-2 | (E) | (X) | 121 | 255 | 63 |
| Comparative Example 9 | (1)-2 | (2)-5 | (X) | 89 | 184 | 98 |
| Comparative Example 10 | (1)-2 | — | (5)-4 | 61 | 99 | 7 |
| Comparative Example 11 | — | (2)-5 | (5)-4 | 135 | 241 | 36 |
| Comparative Example 12 | (1)-2 | (2)-5 | (Y) | 61 | 105 | 30 |
| Comparative Example 13 | (1)-2 | (2)-5 | (Z) | 63 | 110 | 23 |
| Comparative Example 14 | (F) | (2)-5 | (5)-4 | 72 | 125 | 12 |

* In Table 1, the charge transport substances (A) to (F) used for comparison do not have a chemical structure represented by formulae (2) or (6) but for the sake of convenience, are placed in the columns of Charge Transport Substances (1) and (2) in the Table.

As seen from Table 1, the photoreceptors of Examples of this application are improved in both the electrical characteristics and the crack resistance. On the other hand, when the charge transport substances of Comparative Examples 1 to 5 are used, the crack resistance is deteriorated, and when the polyarylate resins of Comparative Examples 6 to 9 are used, the crack resistance is good but the electrical characteristics (responsivity) are deteriorated. Furthermore, in Comparative Examples 10 and 11 where only one kind of a charge transport substance is used, the crack resistance is deteriorated in Comparative Example 10, and precipitation of the charge transport substance is observed and the electrical characteristics (responsivity) are deteriorated in Comparative Example 11. Also in Comparative Examples 12 and 13 where a different kind of a polycarbonate resin is used, the crack resistance is deteriorated as compared with the polycarbonate resin of this application. In Comparative Example 14, the electrical characteristics and the crack resistance are deteriorated.

Example 7

Production of Photoreceptor Drum

On an aluminum-made cylinder having a rough cut finished and cleanly washed surface and having an outer diameter of 30 mm, a length of 260.5 mm and a wall thickness of 0.75 mm, the coating solution for undercoat layer formation, the coating solution for charge generation layer formation, and the coating solution for charge transport layer formation each used for the production of the photoreceptor of Example 1 were successively coated by a dip coating method and dried to form a undercoat layer, a charge generation layer and a charge transport layer having a dry thickness of 1.3 μm, 0.4 μm, and 25 μm, respectively, whereby a photoreceptor drum was produced. Incidentally, drying of the charge transport layer was performed at 125° C. for 20 minutes.

<Image Test>

The image test was performed using a tandem-type color laser printer HP Color LaserJet 4700 do manufactured by Hewlett-Packard Co. in which a resin-made charging roller is used.

The produced photoreceptor drum (four drums equivalent in quality) was loaded in a process cartridge for each of cyan, magenta, yellow and black colors and stored at 55° C. for 1 week. Even under such conditions, a crack attributable to pressure-contact with the charging roller was not observed on the photoreceptor surface. This cartridge was mounted in the printer above, and an image formation test on 8,000 sheets was performed in an environment at a temperature of 25° C. and a humidity of 50%. As a result, an image defect due to ghost, fogging, density reduction, filming, cleaning failure, scratch or the like was generated, and a good image was obtained.

Comparative Example 15

A photoreceptor drum was produced and an image test was performed in the same manner as in Example 7 except that the coating solution for charge transport layer used in the production of photoreceptor of Comparative Example 1 was used in place of the coating solution for charge transport layer used in the production of photoreceptor of Example 7. Many cracks were generated in the photoreceptor surface portion which had been abutted with the charging roller in the cartridge before the image test, and recognized as streaky defects in the image. Also, an image formation test on 8,000 sheets was performed in an environment at a temperature of 25° C. and a humidity of 50%, as a result, ghost and density reduction were observed.

Reference Example

Sebum was attached to the surface of the photoreceptor used in each of Examples 1 to 6 and Comparative Examples 1 to 13 and left standing for 48 hours, and thereafter, the presence or absence of cracking was confirmed by microscope observation. As a result, cracking was observed only in the photoreceptors used in Comparative Examples 2 and 10, and cracking was not recognized in other photoreceptors. That is, it is understood that the conventional test by attachment of sebum is improper as a durability test for cracking caused by contact with a member.

This application is based on Japanese patent application JP 2012-027438, filed on Feb. 10, 2012, the entire content of which is hereby incorporated by reference, the same as if set forth at length.

What is claimed is:

1. An electrophotographic photoreceptor, comprising a conductive support, a charge transport layer, and a charge generation layer on the conductive support, wherein the charge transport layer comprises:

a charge transport substance represented by the following formula (2):

(2)

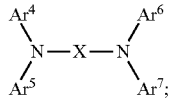

a charge transport substance represented by the following formula (6):

(6)

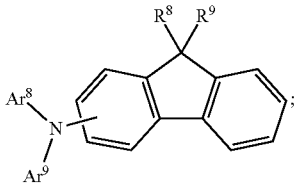

; and a polycarbonate resin having a structural unit represented by the following formula (5) as a binder resin:

(5)

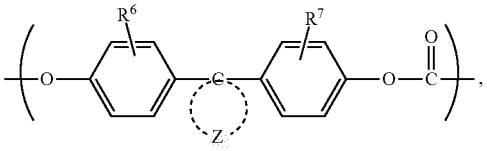

wherein:

and the first and second charge transport substances and the polycarbonate resin are present in the same layer;

each of $Ar^4$ to $Ar^7$ independently represents an optionally-substituted aryl group having a carbon number of 30 or less;

X represents a divalent substituent represented by the formula (3);

(3)

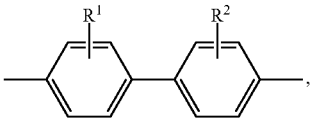

each of $R^1$ and $R^2$ independently represents a hydrogen atom or an alkyl group having a carbon number of 6 or less, provided that when X is the divalent substituent represented by the formula (3), each of $Ar^4$ and $Ar^6$ is independently an optionally-substituted phenyl group and each of $Ar^5$ and $Ar^7$ is independently an optionally-substituted naphthyl group;

each of $Ar^8$ and $Ar^9$ independently represents an optionally-substituted aryl group having a carbon number of 30 or less;

each of $R^8$ and $R^9$ independently represents a hydrogen atom or an alkyl group having a carbon number of 6 or less;

each of $R^6$ and $R^7$ represents a hydrogen atom or an alkyl group having a carbon number of 4 or less; and Z represents a cyclic aliphatic alkyl group having a total carbon number of 5 to 9 including the carbon atom of the bonding site, wherein the total amount of the charge transport substance represented by the formula (6) and the charge transport substance represented by the formula (2), in terms of weight per 100 parts by weight of the binder resin, is from 70 to 110 parts, and wherein a mixing ratio of the charge transport substance represented by the formula (6) and the charge transport substance represented by the formula (2) is from 40:60 to 90:10.

2. The electrophotographic photoreceptor of claim 1, wherein the charge generation layer contains a gallium phthalocyanine as a charge generating substance.

3. An electrophotographic photoreceptor cartridge comprising:

the electrophotographic photoreceptor of claim 1; and at least one member selected from the group consisting of a charging device for charging the electrophotographic photoreceptor, an exposure device for exposing the charged electrophotographic photoreceptor to form an electrostatic latent image, and a developing device for developing the electrostatic latent image formed on the electrophotographic photoreceptor.

4. An image forming apparatus, comprising:

the electrophotographic photoreceptor claimed in claim 1;

a charging device for charging the electrophotographic photoreceptor;

an exposure device for exposing the charged electrophotographic photoreceptor to form an electrostatic latent image; and a developing device for developing the electrostatic latent image formed on the electrophotographic photoreceptor.

5. The image forming apparatus of claim 4, which employs a contact developing system.

6. The image forming apparatus claim 4, which employs a contact charging system.

* * * * *